US009466305B2

(12) United States Patent
Sen et al.

(10) Patent No.: US 9,466,305 B2
(45) Date of Patent: Oct. 11, 2016

(54) PERFORMING POSITIONAL ANALYSIS TO CODE SPHERICAL HARMONIC COEFFICIENTS

(71) Applicant: QUALCOMM Incorporated, San Diego, CA (US)

(72) Inventors: Dipanjan Sen, San Diego, CA (US); Nils Günther Peters, San Diego, CA (US); Martin James Morrell, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/288,320

(22) Filed: May 27, 2014

(65) Prior Publication Data

US 2014/0358557 A1 Dec. 4, 2014

Related U.S. Application Data

(60) Provisional application No. 61/828,610, filed on May 29, 2013, provisional application No. 61/828,615, filed on May 29, 2013.

(51) Int. Cl.

| | |
|---|---|
| ***G10L 19/00*** | (2013.01) |
| ***G10L 21/00*** | (2013.01) |
| ***G10L 21/04*** | (2013.01) |
| ***G10L 19/02*** | (2013.01) |
| ***G10L 19/008*** | (2013.01) |

(52) U.S. Cl.

CPC ..... *G10L 19/02* (2013.01); *G10L 19/008* (2013.01); *H04S 2420/11* (2013.01)

(58) Field of Classification Search

USPC ..... 704/500, 503

See application file for complete search history.

(56) References Cited

U.S. PATENT DOCUMENTS

| | | | | |
|---|---|---|---|---|
| 4,709,340 | A | 11/1987 | Capizzi et al. | |
| 5,757,927 | A | 5/1998 | Gerzon et al. | |
| 5,970,443 | A | 10/1999 | Fujii | |
| 6,263,312 | B1 * | 7/2001 | Kolesnik et al. | 704/500 |

(Continued)

FOREIGN PATENT DOCUMENTS

| | | |
|---|---|---|
| EP | 2234104 A1 | 9/2010 |
| EP | 2450880 A1 | 5/2012 |

(Continued)

OTHER PUBLICATIONS

Hagai et al, "Acoustic centering of sources measured by surrounding spherical microphone arrays", 2011, In The Journal of the Acoustical Society of America, vol. 130, No. 4, p. 2003-2015.*

(Continued)

*Primary Examiner* — Olujimi Adesanya

(74) *Attorney, Agent, or Firm* — Shumaker & Sieffert, P.A.

(57) ABSTRACT

In general, techniques are described for performing a positional analysis to code audio data. Typically, this audio data comprises a hierarchical representation of a soundfield and may include, as one example, spherical harmonic coefficients (which may also be referred to as higher-order ambisonic coefficients). An audio compression device that includes one or more processors may perform the techniques. The processors may be configured to allocate bits to one or more portions of the audio data, at least in part by performing positional analysis on the audio data.

42 Claims, 18 Drawing Sheets

(56) References Cited

U.S. PATENT DOCUMENTS

| | | | | |
|---|---|---|---|---|
| 7,271,747 | B2 | 9/2007 | Baraniuk et al. | |
| 7,920,709 | B1 | 4/2011 | Hickling | |
| 8,160,269 | B2 | 4/2012 | Mao et al. | |
| 8,374,358 | B2 | 2/2013 | Buck et al. | |
| 8,379,868 | B2 | 2/2013 | Goodwin et al. | |
| 8,391,500 | B2 | 3/2013 | Hannemann et al. | |
| 8,570,291 | B2 | 10/2013 | Motomura et al. | |
| 8,817,991 | B2 | 8/2014 | Jaillet et al. | |
| 8,964,994 | B2 | 2/2015 | Jaillet et al. | |
| 9,053,697 | B2 | 6/2015 | Park et al. | |
| 9,084,049 | B2 | 7/2015 | Fielder et al. | |
| 9,100,768 | B2 | 8/2015 | Batke et al. | |
| 9,129,597 | B2 | 9/2015 | Bayer et al. | |
| 9,338,574 | B2 | 5/2016 | Jax et al. | |
| 2001/0036286 | A1* | 11/2001 | Layton et al. | 381/304 |
| 2002/0044605 | A1 | 4/2002 | Nakamura | |
| 2002/0169735 | A1 | 11/2002 | Kil et al. | |
| 2003/0147539 | A1 | 8/2003 | Elko et al. | |
| 2004/0131196 | A1* | 7/2004 | Malham | 381/61 |
| 2004/0158461 | A1 | 8/2004 | Ramabadran et al. | |
| 2006/0126852 | A1* | 6/2006 | Bruno et al. | 381/17 |
| 2007/0269063 | A1 | 11/2007 | Goodwin et al. | |
| 2008/0137870 | A1 | 6/2008 | Nicol et al. | |
| 2008/0306720 | A1 | 12/2008 | Nicol et al. | |
| 2009/0092259 | A1* | 4/2009 | Jot et al. | 381/17 |
| 2009/0248425 | A1 | 10/2009 | Vetterli et al. | |
| 2010/0085247 | A1 | 4/2010 | Venkatraman et al. | |
| 2010/0092014 | A1 | 4/2010 | Strauss et al. | |
| 2010/0198585 | A1 | 8/2010 | Mouhssine et al. | |
| 2010/0329466 | A1 | 12/2010 | Berge | |
| 2011/0224995 | A1 | 9/2011 | Kovesi et al. | |
| 2011/0249738 | A1 | 10/2011 | Suzuki et al. | |
| 2011/0249821 | A1* | 10/2011 | Jaillet | G10L 19/008 381/22 |
| 2011/0261973 | A1* | 10/2011 | Nelson et al. | 381/92 |
| 2011/0305344 | A1* | 12/2011 | Sole et al. | 381/22 |
| 2012/0014527 | A1* | 1/2012 | Furse | 381/17 |
| 2012/0093344 | A1* | 4/2012 | Sun | H04R 3/005 381/122 |
| 2012/0155653 | A1* | 6/2012 | Jax et al. | 381/22 |
| 2012/0163622 | A1 | 6/2012 | Karthik et al. | |
| 2012/0174737 | A1 | 7/2012 | Risan | |
| 2012/0243692 | A1 | 9/2012 | Ramamoorthy | |
| 2012/0259442 | A1* | 10/2012 | Jin et al. | 700/94 |
| 2012/0314878 | A1* | 12/2012 | Daniel et al. | 381/23 |
| 2013/0010971 | A1 | 1/2013 | Batke et al. | |
| 2013/0028427 | A1 | 1/2013 | Yamamoto et al. | |
| 2013/0041658 | A1 | 2/2013 | Bradley et al. | |
| 2013/0148812 | A1 | 6/2013 | Corteel et al. | |
| 2013/0216070 | A1* | 8/2013 | Keiler et al. | 381/300 |
| 2013/0223658 | A1 | 8/2013 | Betlehem et al. | |
| 2014/0016786 | A1 | 1/2014 | Sen | |
| 2014/0023197 | A1* | 1/2014 | Xiang | H04S 1/007 381/17 |
| 2014/0025386 | A1 | 1/2014 | Xiang et al. | |
| 2014/0029758 | A1 | 1/2014 | Nakadai et al. | |
| 2014/0219455 | A1 | 8/2014 | Peters et al. | |
| 2014/0226823 | A1 | 8/2014 | Sen et al. | |
| 2014/0233762 | A1 | 8/2014 | Vilkamo et al. | |
| 2014/0233917 | A1* | 8/2014 | Xiang | G11B 27/031 386/285 |
| 2014/0247946 | A1 | 9/2014 | Sen et al. | |
| 2014/0270245 | A1 | 9/2014 | Elko et al. | |
| 2014/0286493 | A1 | 9/2014 | Kordon et al. | |
| 2014/0307894 | A1 | 10/2014 | Kordon et al. | |
| 2014/0355766 | A1 | 12/2014 | Morrell et al. | |
| 2014/0355769 | A1 | 12/2014 | Peters et al. | |
| 2014/0355770 | A1 | 12/2014 | Peters et al. | |
| 2014/0355771 | A1 | 12/2014 | Peters et al. | |
| 2014/0358266 | A1 | 12/2014 | Peters et al. | |
| 2014/0358558 | A1 | 12/2014 | Sen et al. | |
| 2014/0358559 | A1 | 12/2014 | Sen et al. | |
| 2014/0358560 | A1 | 12/2014 | Sen et al. | |
| 2014/0358561 | A1 | 12/2014 | Sen et al. | |
| 2014/0358562 | A1 | 12/2014 | Sen et al. | |
| 2014/0358563 | A1 | 12/2014 | Sen et al. | |
| 2014/0358564 | A1 | 12/2014 | Sen et al. | |
| 2014/0358565 | A1 | 12/2014 | Peters et al. | |
| 2015/0098572 | A1 | 4/2015 | Krueger et al. | |
| 2015/0154965 | A1 | 6/2015 | Wuebbolt et al. | |
| 2015/0154971 | A1 | 6/2015 | Boehm et al. | |
| 2015/0163615 | A1 | 6/2015 | Boehm et al. | |
| 2015/0213803 | A1 | 7/2015 | Peters et al. | |
| 2015/0213805 | A1 | 7/2015 | Peters et al. | |
| 2015/0213809 | A1 | 7/2015 | Peters et al. | |
| 2015/0264483 | A1 | 9/2015 | Morrell et al. | |
| 2015/0264484 | A1 | 9/2015 | Peters et al. | |
| 2015/0287418 | A1 | 10/2015 | Vasilache et al. | |
| 2015/0332679 | A1 | 11/2015 | Kruger et al. | |
| 2015/0332690 | A1 | 11/2015 | Kim et al. | |
| 2015/0332691 | A1 | 11/2015 | Kim et al. | |
| 2015/0332692 | A1 | 11/2015 | Kim et al. | |
| 2015/0341736 | A1 | 11/2015 | Peters et al. | |
| 2015/0358631 | A1 | 12/2015 | Zhang et al. | |
| 2015/0380002 | A1 | 12/2015 | Uhle et al. | |
| 2016/0093308 | A1 | 3/2016 | Kim | |
| 2016/0093311 | A1 | 3/2016 | Kim | |
| 2016/0174008 | A1 | 6/2016 | Boehm | |

FOREIGN PATENT DOCUMENTS

| | | | |
|---|---|---|---|
| EP | 2469741 | A1 | 6/2012 |
| EP | 2765791 | A1 | 8/2013 |
| EP | 2665208 | A1 | 11/2013 |
| EP | 2954700 | A1 | 12/2015 |
| TW | 201514455 | A | 4/2015 |
| WO | 2009046223 | A2 | 4/2009 |
| WO | 2012059385 | A1 | 5/2012 |
| WO | 2014013070 | A1 | 1/2014 |
| WO | 2014122287 | A1 | 8/2014 |
| WO | 2014177455 | A1 | 11/2014 |
| WO | 2014194099 | A1 | 12/2014 |
| WO | 2015007889 | A2 | 1/2015 |

OTHER PUBLICATIONS

Gerzon, "Ambisonics in Multichannel Broadcasting and Video," 1985, In J. Audio Eng. Soc., vol. 33, pp. 859-871.*

Malham, "Higher order ambisonic systems for the spatialization of sound,", 1999, in Proc. Int. Computer Music Conf., Beijing, China pp. 484-487.*

Moreau et al, 3D Sound Field Recording with Higher Order Ambisonics—Objective Measurements and Validation of Spherical Microphone, 2006, Audio Engineering Society Convention Paper 6857, pp. 1-24.*

Davis et al, "A Simple and Efficient Method for Real-Time Computation and Transformation of Spherical Harmonic-Based Sound Fields", 2012, Proceedings of the AES 133rd Convention. pp. 1-10.*

Solvang et al, "Quantization of Higher Order Ambisoncs wave fields," 2008, In The 124th AES Conv., 2008, pp. 1-9.*

Daniel et al, "Multichannel Audio Coding Based on Minimum Audible Angles", 2010, In Proceedings of the AES 40th Conference on Spatial Audio, Oct. 2010, pp. 1-10.*

Nishimura, "Audio Information Hiding Based on Spatial Masking," 2010, In Intelligent Information Hiding and Multimedia Signal Processing (IIH-MSP), 2010 Sixth International Conference on , vol., No., pp. 522-525, Oct. 15-17, 2010.*

Daniel et al., "Ambisonics Encoding of Other Audio Formats for Multiple Listening Conditions," Audio Engineering Society Convention 105, Sep. 1998, San Francisco, CA, Paper No. 4795, 29 pp.

Gauthier et al., "Beamforming regularization, scaling matrices and inverse problems for sound field extrapolation and characterization: Part I Theory," 2011, in Audio Engineering Society 131st Convention, New York, USA, Oct. 2011, pp. 1-32.

Gauthier et al., "Derivation of Ambisonics Signals and Plane Wave Description of Measured Sound Field Using Irregular Microphone Arrays and Inverse Problem Theory," 2011, In Ambisonics Symposium 2011, Lexington, Jun. 2011, pp. 1-17.

Pulkki, "Spatial Sound Reproduction with Directional Audio Coding," Journal of the Audio Engineering Society, Jun. 2007, vol. 55 (6), pp. 503-516.

(56) References Cited

OTHER PUBLICATIONS

Rafaely, "Spatial alignment of acoustic sources based on spherical harmonics radiation analysis," 2010, Control and Signal Processing (ISCCSP), 2010 4th International Symposium on Communications, vol. No., Mar. 3-5, 2010, 5 pp.
International Preliminary Report on Patentability from International Application No. PCT/US2014/039862, dated Aug. 7, 2015, 8 pp.
U.S. Appl. No. 14/729,486, filed Jun. 3, 2015, by Zhang et al.
Poletti, et al., "Three-Dimensional Surrond Sound Systems Based on Spherical Harmonics," J. Audio Eng. Soc., vol. 53, No. 11, Nov. 2005, pp. 1004-1025.
Heere, et al., "MPEG-H 3D Audio—The New Standard for Coding of Immersive Spatial Audio," IEE Journal of Selected Topics in Signal Processing, vol. 5, No. 5, Aug. 15, pp. 770-779.
"Calls for Proposals for 3D Audio," ISO/IEC JTC1/SC29/WG11/N13411, Jan. 2013, 20 pp.
"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.
"Information technology—High efficiency coding and media delivery in heterogeneous environments—Part 3: 3D Audio," ISO/IEC JTC 1/SC 29N, Apr. 4, 2014, 337 pages.
"Information technology—High efficiency coding and media delivery in heterogeneous environments—Part 3: 3D Audio," ISO/IEC JTC 1/SC 29N, Jul. 25, 2005, 311 pp.
Audio, "Call for Proposals for 3D Audio," International Organisation for Standardisation Organisation Internationale De Normalisation ISO/IEC JTC1/SC29/WG11 Coding of Moving Pictures and Audio, ISO/IEC JTC1/SC29/WG11/N13411, Geneva, Jan. 2013, 20 pp.
Audio-Subgroup: "WD1-HOA Text of MPEG-H 3D Audio," MPEG Meeting; Jan. 2014; San Jose; (Motion Picture Expert Group or ISO/IEC JTC1/SC29/WG11), No. N14264, XP030021001, 82 pp.
Boehm J., et al., "Scalable Decoding Mode for MPEG-H 3D Audio HOA," MPEG Meeting; Mar. 2014; Valencia; (Motion Picture Expert Group or ISO/IEC JTC1/SC29/WG11),, No. m33195, XP030061647, 12 pp.
Boehm, et al., "Detailed Technical Description of 3D Audio Phase 2 Reference Model 0 for HOA technologies", MPEG Meeting; Oct. 2014; Strasbourg; (Motion Picture Expert Group or ISO/IEC JTC1/SC29/WG11), No. m35857, XP030063429, 130 pp.
Boehm, et al., "HOA Decoder—changes and proposed modification," Technicolor, MPEG Meeting; Mar. 2014; Valencia; (Motion Picture Expert Group or ISO/IEC JTC1/SC29/WG11), No. m33196, XP030061648, 16 pp.
Daniel, et al., "Spatial Auditory Blurring and Applications to Multichannel Audio Coding", Jun. 23, 2011, XP055104301, Retrieved from the Internet: URL:http://tel.archives-ouvertes.fr/tel-00623670/en/Chapter 5. "Multichannel audio coding based on spatial blurring", 167 pp.
DVB Organization: "ISO-IEC_23008-3_(E)_(DIS of 3DA).docx", DVB, Digital Video Broadcasting, C/0 EBU—17A Ancienne Route—CH-1218 Grand Saconnex, Geneva—Switzerland, Aug. 8, 2014, XP017845569, 431 pp.
Erik, et al., "Lossless Compression of Spherical Microphone Array Recordings," AES Convention 126, May 2009, AES, 60 East 42nd Street, Room 2520 New York 10165-2520, USA, XP040508950, Section 2, Higher Order Ambisonics; 9 pp.
Hellerud, et al., "Encoding higher order ambisonics with AAC," Audio Engineering Society—124th Audio Engineering Society Convention May 17-20, 2008, XP040508582, May 2008, 8 pp.
Hellerud, et al., "Spatial redundancy in Higher Order Ambisonics and its use for lowdelay lossless compression", Acoustics, Speech and Signal Processing, Apr. 2009, ICASSP 2009, IEEE International Conference on, IEEE, Piscataway, NJ, USA, XP031459218, pp. 269-272.
International Search Report and Written Opinion from International Application No. PCT/US2014/039862, dated Aug. 18, 2014, 11 pp.
Menzies, "Nearfield synthesis of complex sources with high-order ambisonics, and binural rendering," Proceedings of the 13th International Conference on Auditory Display, Montr'eal, Canada, Jun. 26-29, 2007, 8 pp.
Poletti, "Three-Dimensional Surround Sound Systems Based on Spherical Harmonics," The Journal of the Audio Engineering Society, Nov. 2005, vol. 53 (11), pp. 1004-1025.
Sen et al., "RM1-HOA Working Draft Text", MPEG Meeting; Jan. 2014; San Jose; (Motion Picture Expert Group or ISO/IEC JTC1/SC29/WG11), No. m31827, XP030060280, 83 pp.
Wabnitz, et al., "A frequency-domain algorithm to upscale ambisonic sound scenes", 2012 IEEE International Conference on Acoustics, Speech and Signal Processing (ICASSP 2012) : Kyoto, Japan; [Proceedings], IEEE, Piscataway, NJ, Mar. 2012, XP032227141, pp. 385-388.
Wabnitz et al., "Time domain reconstruction of spatial sound fields using compressed sensing", Acoustics, Speech and Signal Processing (ICASSP), 2011 IEEE International Conference On, IEEE, May 2011, XP032000775, pp. 465-468.
Wabnitz, et al., "Upscaling Ambisonic sound scenes using compressed sensing techniques", Applications of Signal Processing to Audio and Acoustics (WASPAA), Oct. 16-19, 2011 IEEE Workshop On, IEEE, XP032011510, 4 pp.
Zotter, et al., "Comparison of energy-preserving and all-round Ambisonic decoders," Mar. 2013, 4 pp.
Sen, et al., "Differences and similarities in formats for scene based audio," ISO/IEC JTC1/SC29/WG11 MPEG2012/M26704, Oct. 2012, 7 pp.
Poletti, et al., "Unified Description of Ambisonics Using Real and Complex Spherical Harmonics," Ambisonics Symposium, Jun. 25-27, 2009, 10 pp.
Painter, et al., "Perceptual Coding of Digital Audio," Proceedings of the IEEE, vol. 88, No. 4, Apr. 2000, pp. 451-531.
Response to Written Opinion dated Apr. 18, 2014 from International Application No. PCT/US2014/039862, filed on Mar. 26, 2015, 34 pp.
Second Written Opinion from International Application No. PCT/US2014/039862, dated May 12, 2015, 7 pp.
Herre, et al., "MPEG-H 3D Audio—The New Standard for Coding of Immersive Spatial Audio," IEEE Journal of Selected Topics in Signal Processing, vol. 9, No. 5, Aug. 2015, 10 pp.
Information technology—MPEG audio technologies—Part 3: Unified speech and audio coding, ISO/IEC JTC 1/SC 26/WG 11, Sep. 20, 2011, 291 pp.
Conlin, "Interpolation of Data Points on a Sphere: Spherical Harmonics as Basis Functions," Feb. 28, 2012, 6 pp.
Wabnitz, et al., "A frequency-domain algorithm to upscale ambisonic sound scenes", 2012 IEEE International Conference on Acoustics, Speech and Signal Processing (ICASSP 2012) : Kyoto, Japan, Mar. 25-30, 2012; [Proceedings], IEEE, Piscataway, NJ, Mar. 25, 2012, pp. 385-388, XP032227141, DOI: 10.1109/ICASSP.2012.6287897, ISBN: 978-1-4673-0045-2.
Stohl, et al., "An Intercomparison of Results from Three Trajectory Models," Meteorological Applications, Jun. 2001, pp. 127-135.
Sayood, et al., "Application to Image Compression—JPEG," Introduction to Data Compression, Third Edition, Dec. 15, 2005, Chapter 13.6, pp. 410-416.
Ruffini, et al., "Spherical Harmonics Interpolation, Computation of Laplacians and Gauge Theory," Starlab Research Knowledge, Oct. 25, 2001, 16 pp.
Daniel, et al., "Spatial Auditory Blurring and Applications to Multichannel Audio Coding", Jun. 23, 2011, XP055104301, Retrieved from the Internet: URL:http://tel.archives-ouvertes.fr/tel-00623670/en/Chapter 5. "Multichannel audio coding based on spatial blurring", p. 121-p. 139.
Mathews, et al., "Multiplication-Free Vector Quantization Using L1 Distortion Measureand ITS Variants", Multidimensional Signal Processing, Audio and Electroacoustics, Glasgow, May 23-26, 1989, [International Conference on Acoustics, Speech & Signal Processing, ICASSP], New York, IEEE, US, May 23, 1989 , vol. 3, pp. 1747-1750, XP000089211.
Nelson et al., "Spherical Harmonics, Singular-Value Decomposition and the Head-Related Transfer Function," Aug. 29, 2000, ISVR University of Southampton, 31 pp.
Rockway, et al., "Interpolating Spherical Harmonics for Computing Antenna Patterns,"Systems Center Pacific, Technical Report 1999, Jul. 2011, 40 pp.
Masgrau, et al., "Predictive SVD-Transform Coding of Speech with Adaptive Vector Quantization," Apr. 1991, IEEE, pp. 3681-3684.

* cited by examiner

PERFORMING POSITIONAL ANALYSIS TO CODE SPHERICAL HARMONIC COEFFICIENTS

This application claims the benefit of U.S. Provisional Application No. 61/828,610, filed May 29, 2013, and U.S. Provisional Application No. 61/828,615, filed May 29, 2013.

TECHNICAL FIELD

The invention relates to audio data and, more specifically, coding of audio data.

BACKGROUND

A higher order ambisonics (HOA) signal (often represented by a plurality of spherical harmonic coefficients (SHC) or other hierarchical elements) is a three-dimensional representation of a sound field. This HOA or SHC representation may represent this sound field in a manner that is independent of the local speaker geometry used to playback a multi-channel audio signal rendered from this SHC signal. This SHC signal may also facilitate backwards compatibility as this SHC signal may be rendered to well-known and highly adopted multi-channel formats, such as a 5.1 audio channel format or a 7.1 audio channel format. The SHC representation may therefore enable a better representation of a sound field that also accommodates backward compatibility.

SUMMARY

In general, techniques are described for coding of spherical harmonic coefficients based on a positional analysis.

In one aspect, a method of compressing audio data, the method comprises allocating bits to one or more portions of the audio data, at least in part by performing positional analysis on the audio data.

In another aspect, an audio compression device comprises one or more processors configured to allocate bits to one or more portions of the audio data, at least in part by performing positional analysis on the audio data.

In another aspect, an audio compression device comprises means for storing audio data, and means for allocating bits to one or more portions of the audio data, at least in part by performing positional analysis on the audio data.

In another aspect, a non-transitory computer-readable storage medium has stored thereon instructions that, when executed, cause one or more processors to allocate bits to one or more portions of the audio data, at least in part by performing positional analysis on the audio data.

In another aspect, a method includes generating a bitstream that includes the plurality of positionally masked spherical harmonic coefficients.

In another aspect, a method includes performing positional analysis based on a plurality of spherical harmonic coefficients that describe a sound field of the audio data in three dimensions to identify a positional masking threshold, allocating bits to each of the plurality of spherical harmonic coefficients at least in part by performing positional masking with respect to the plurality of spherical harmonic coefficients using the positional masking threshold, and generating a bitstream that includes the plurality of positionally masked spherical harmonic coefficients.

In one aspect, a method of compressing audio data includes determining a positional masking matrix based on simulated data expressed in a spherical harmonics domain.

In another aspect, a method includes applying a positional masking matrix to one or more spherical harmonic coefficients to generate a positional masking threshold In another aspect, a method of compressing audio data includes determining a positional masking matrix based on simulated data expressed in a spherical harmonics domain, and applying a positional masking matrix to one or more spherical harmonic coefficients to generate a positional masking threshold.

In another aspect, a method of compressing audio data includes determining a radii-based positional mapping of one or more spherical harmonic coefficients (SHC), using one or more complex representations of the SHC.

The details of one or more aspects of the techniques are set forth in the accompanying drawings and the description below. Other features, objects, and advantages of these techniques will be apparent from the description and drawings, and from the claims.

DETAILED DESCRIPTION

Figure 1:
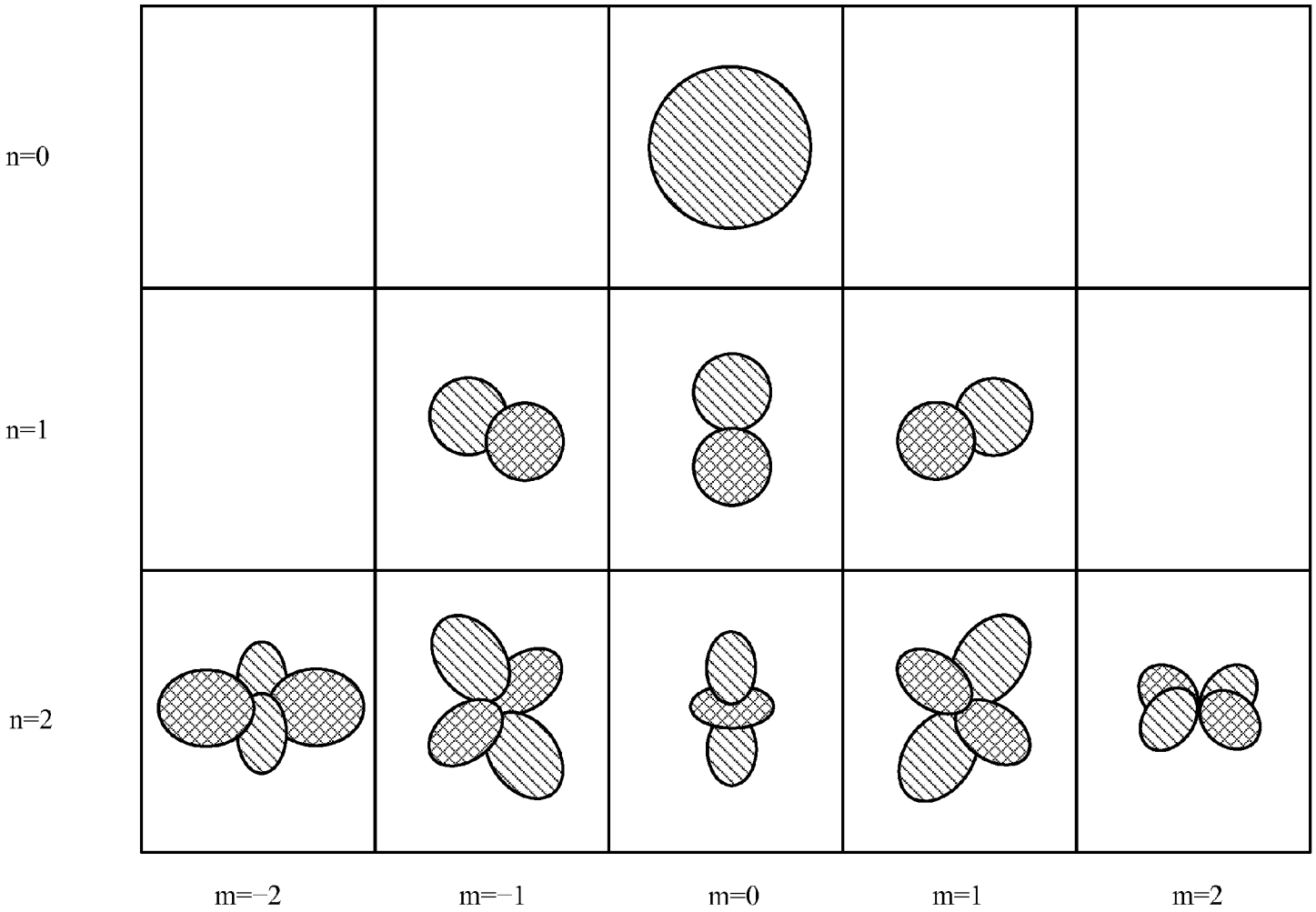
FIGS. 1-3 are diagrams illustrating spherical harmonic basis functions of various orders and sub-orders.

The evolution of surround sound has made available many output formats for entertainment nowadays. Examples of such surround sound formats include the popular 5.1 format (which includes the following six channels: front left (FL), front right (FR), center or front center, back left or surround left, back right or surround right, and low frequency effects (LFE)), the growing 7.1 format, and the upcoming 22.2 format (e.g., for use with the Ultra High Definition Television standard). Further examples include formats for a spherical harmonic array.

The input to the future MPEG encoder is optionally one of three possible formats: (i) traditional channel-based audio, which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the sound field using coefficients of spherical harmonic basis functions (also called "spherical harmonic coefficients" or SHC).

There are various 'surround-sound' formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend the efforts to remix it for each speaker configuration. Recently, standard committees have been considering ways in which to provide an encoding into a standardized bitstream and a subsequent decoding that is adaptable and agnostic to the speaker geometry and acoustic conditions at the location of the renderer.

To provide such flexibility for content creators, a hierarchical set of elements may be used to represent a sound field. The hierarchical set of elements may refer to a set of elements in which the elements are ordered such that a basic set of lower-ordered elements provides a full representation of the modeled sound field. As the set is extended to include higher-order elements, the representation becomes more detailed.

One example of a hierarchical set of elements is a set of spherical harmonic coefficients (SHC). The following expression demonstrates a description or representation of a sound field using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

This expression shows that the pressure $p_i$ at any point $\{r_r, \theta_r, \phi_r\}$ of the sound field can be represented uniquely by the SHC $A_n^m(k)$. Here, $$k = \frac{\omega}{c},$$

c is the speed of sound (~343 m/s), $\{r_r, \theta_r, \phi_r\}$ is a point of reference (or observation point), $j_n(\cdot)$ is the spherical Bessel function of order n, and $Y_n^m(\theta_r, \phi_r)$ are the spherical harmonic basis functions of order n and suborder m. It can be recognized that the term in square brackets is a frequency-domain representation of the signal (i.e., $S(\omega, r_r, \theta_r, \phi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multi-resolution basis functions.

Techniques of this disclosure are generally directed to coding Spherical Harmonic Coefficients (SHC) based on positional characteristics of an underlying soundfield. In examples, the positional characteristics are derived directly from the SHC. An omnidirectional coefficient ($a_0^0$) of the SHC is coded and/or quantized using one or more properties of human hearing, such as simultaneous masking. The rest of the coefficients (e.g., 24 remaining coefficients in the case of a 4th order representation) are quantized using a bit-allocation scheme or mechanism that is based on the saliency of each of the coefficients (in describing directional aspects of the sound field). Two dimensional (2D) entropy coding may be performed to remove any further redundancies within the coefficients.

FIG. 1 is a diagram illustrating a zero-order spherical harmonic basis function (first row), first-order spherical harmonic basis functions (second row) and second-order spherical harmonic basis functions (third row). The order (n) is identified by the rows of the table with the first (topmost) row referring to the zero order, the second (from the top) row referring to the first order and third (in this case, bottom) row referring to the second order. The sub-order (m) is identified by the columns of the table, with the center column having a sub-order of zero, the columns to the immediate left and right of the center having sub-orders of −1 and 1 respectively, and so on. Orders and sub-orders of spherical harmonic basis functions are shown in more detail in FIG. 3. The SHC corresponding to zero-order spherical harmonic basis function may be considered as specifying the energy of the sound field, while the SHCs corresponding to the remaining non-zero order spherical harmonic basis functions may specify the direction of that energy. The SHC corresponding to the zero-order spherical harmonic basis function is referred to herein as an "omnidirectional" SHC, and the SHC corresponding to the remaining non-zero order spherical harmonic basis functions are referred to herein as "higher order" or "higher-order" SHC.

Figure 2:
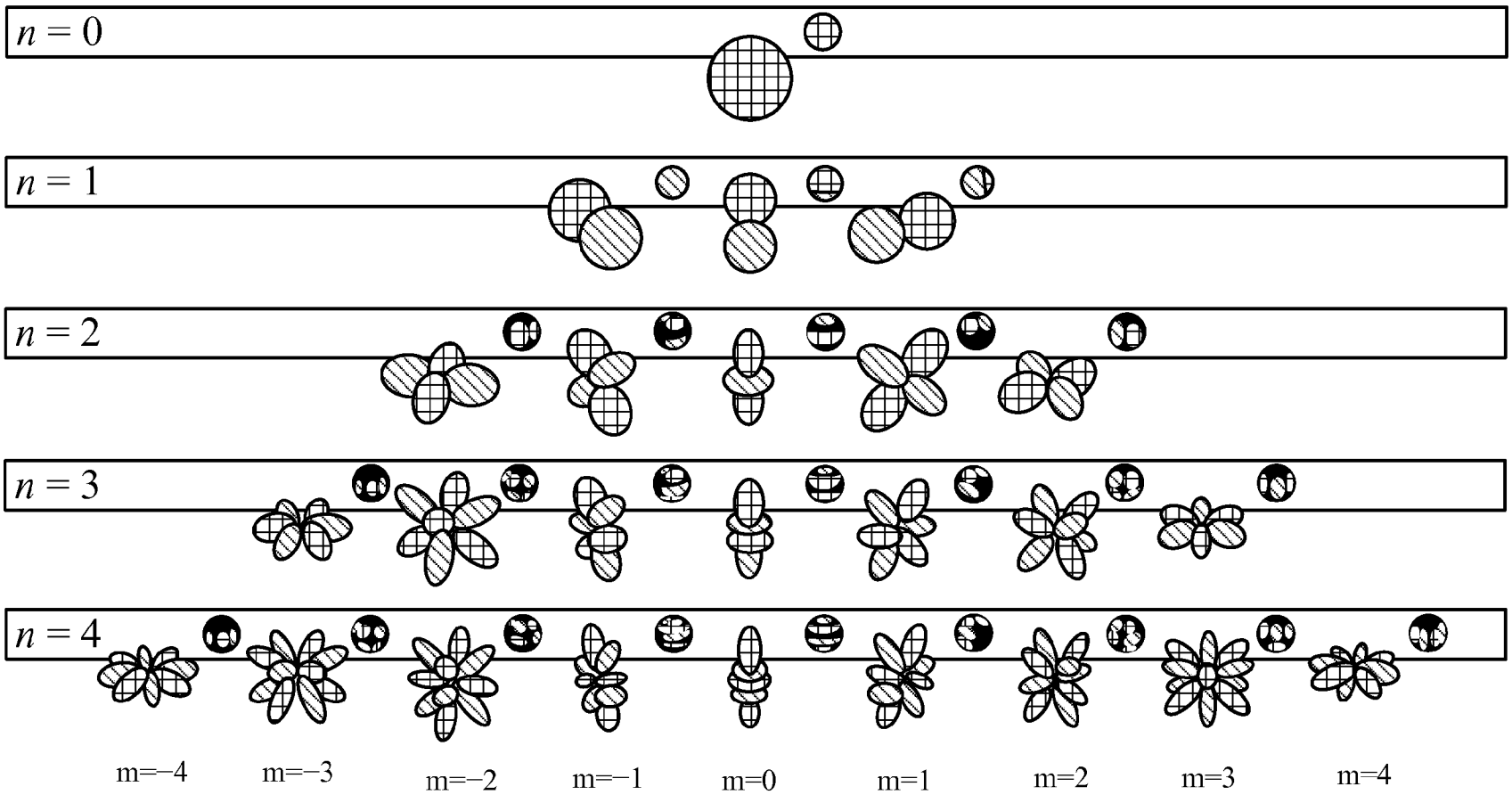

FIG. 2 is a diagram illustrating spherical harmonic basis functions from the zero order (n=0) to the fourth order (n=4). As can be seen, for each order, there is an expansion of suborders m. As shown in FIG. 2, in a four-order scenario, nine sub-orders are possible. More specifically, for each respective order n, the corresponding number of sub-orders m is equal to (2n+1). Also, as shown in FIG. 2, a four-order scenario may include a total 25 SHC, i.e., one omnidirectional SHC with an order-suborder tuple (in this case, pair) of (0,0), and 24 higher-order SHC, each having an order-suborder pair that includes a non-zero order value.

Figure 3:
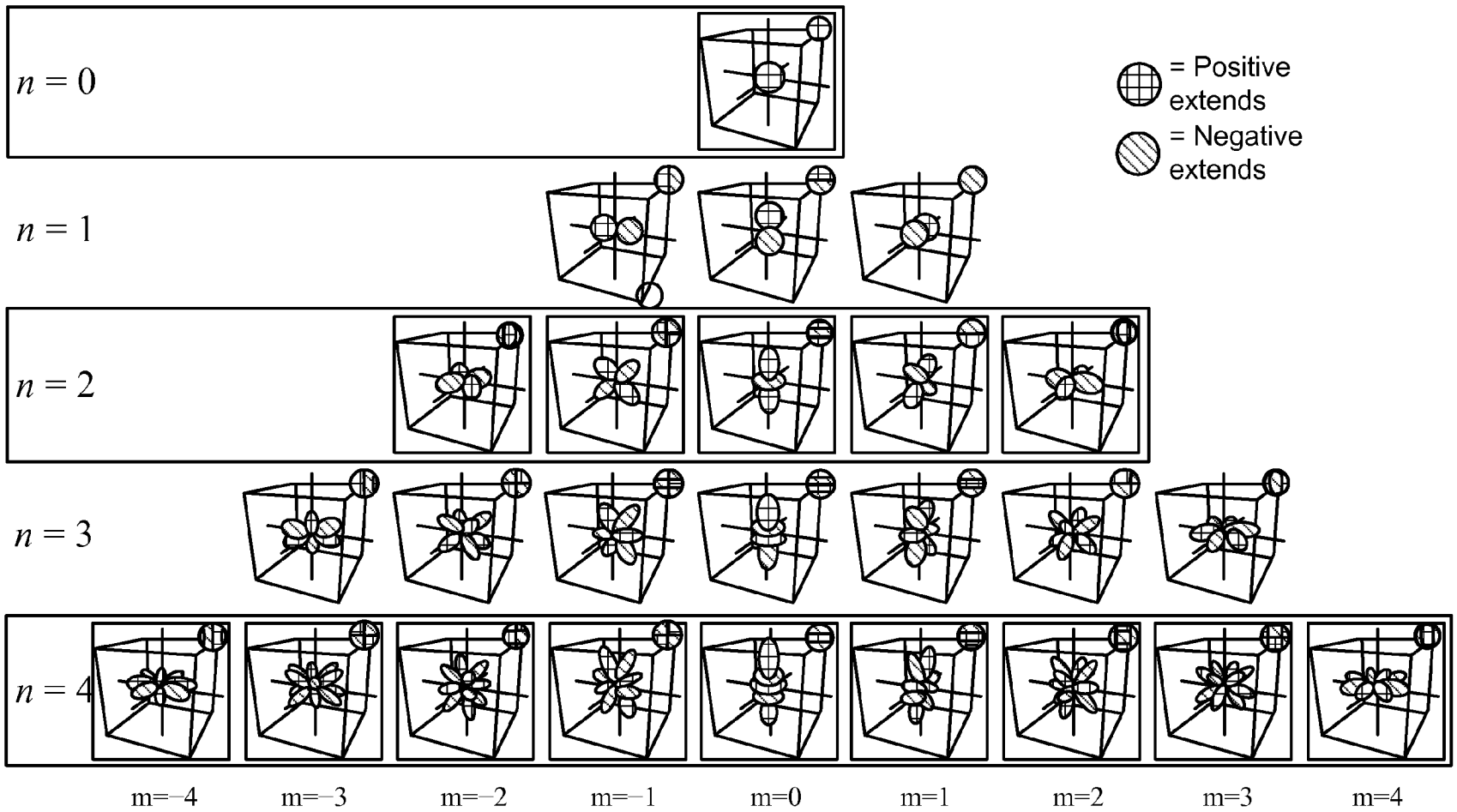

FIG. 3 is another diagram illustrating spherical harmonic basis functions from the zero order (n=0) to the fourth order (n=4). In FIG. 3, the spherical harmonic basis functions are shown in three-dimensional coordinate space with both the order and the suborder shown. Based on the order (n) value range of (0,4), the corresponding suborder (m) value range of FIG. 3 is (−4,4).

In any event, the SHC $A_n^m(k)$ can either be physically acquired (e.g., recorded) by various microphone array configurations or, alternatively, they can be derived from channel-based or object-based descriptions of the sound field. The former represents scene-based audio input to an encoder. For example, a fourth-order representation involving $(1+4)^2$ (25, and hence fourth order) coefficients may be used.

To illustrate how these SHCs may be derived from an object-based description, consider the following equation. The coefficients $A_n^m(k)$ for the sound field corresponding to an individual audio object may be expressed as $$A_n^m(k)=g(\omega)(-4\pi ik)h_n^{(2)}(kr_s)Y_n^{m*}(\theta_s,\phi_s),$$

where i is $\sqrt{-1}$, $h_n^{(2)}(\cdot)$ is the spherical Hankel function (of the second kind) of order n, and $\{r_s, \theta_s, \phi_s\}$ is the location of the object. Knowing the source energy $g(\omega)$ as a function of frequency (e.g., using time-frequency analysis techniques, such as performing a fast Fourier transform on the PCM stream) allows us to convert each PCM object and its location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, these coefficients contain information about the sound field (the pressure as a function of 3D coordinates), and the above represents the transformation from individual objects to a representation of the overall sound field, in the vicinity of the observation point $\{r_r, \theta_r, \phi_r\}$. The remaining figures are described below in the context of object-based and SHC-based audio coding.

FIGS. 4A-4D are block diagrams illustrating example implementations of an audio encoding device 10 that may perform various aspects of the techniques described in this disclosure to code spherical harmonic coefficients describing two or three dimensional sound fields.

Figure 4A:
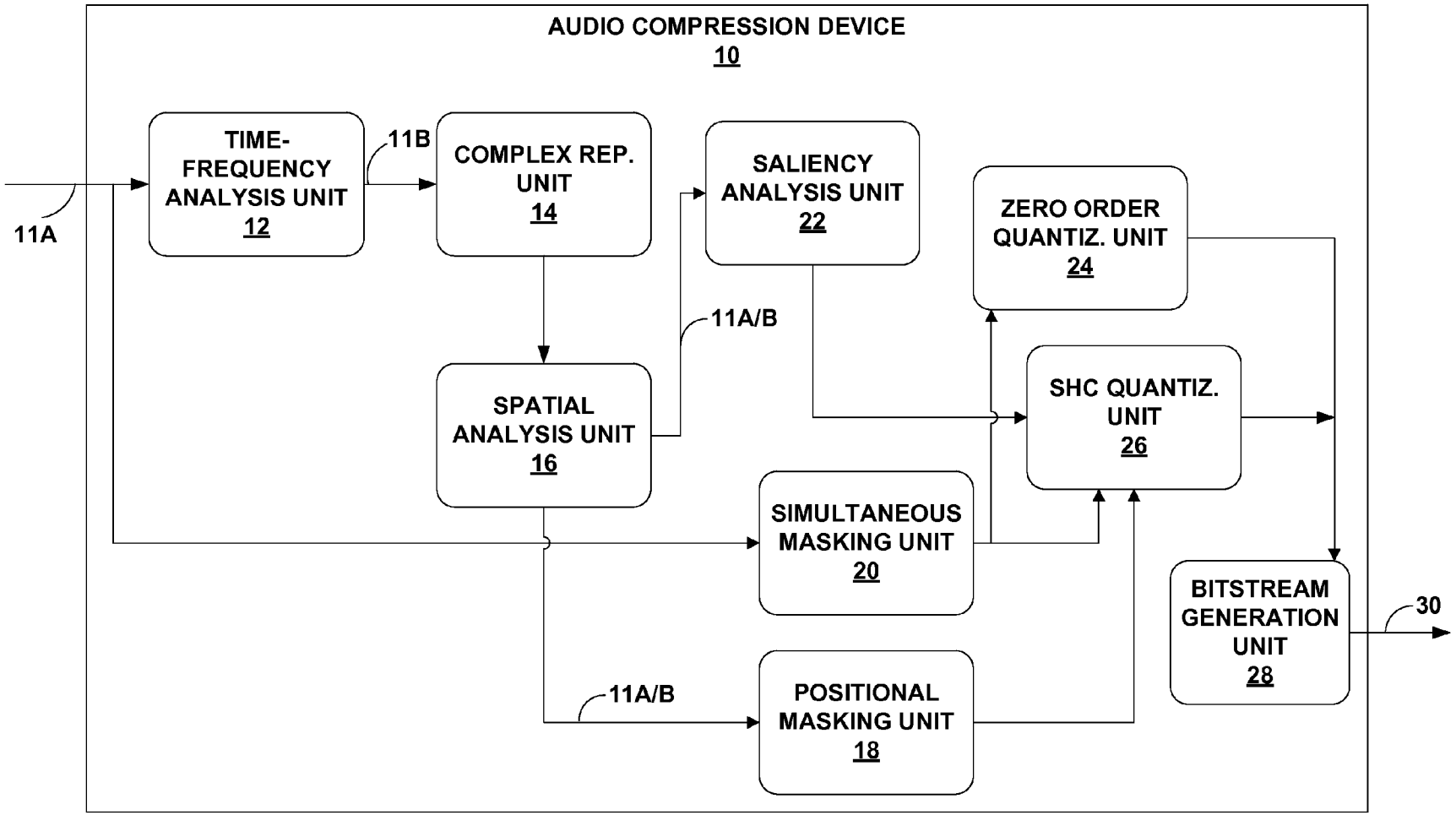
FIGS. 4A-4D are block diagrams illustrating example audio encoding devices that may perform various aspects of the techniques described in this disclosure to code spherical harmonic coefficients describing two or three dimensional sound fields.

FIG. 4A is a block diagram illustrating an example audio compression audio compression device 10 that may perform various aspects of the techniques described in this disclosure to code spherical harmonic coefficients describing two or three dimensional sound fields. The audio compression device 10 generally represents any device capable of encoding audio data, such as a desktop computer, a laptop computer, a workstation, a tablet or slate computer, a dedicated audio recording device, a cellular phone (including so-called "smart phones"), a personal media player device, a personal gaming device, or any other type of device capable of encoding audio data.

While shown as a single device, i.e., the audio compression device 10 in the example of FIG. 4A, the various components or units referenced below as being included within the audio compression device 10 may actually form separate devices that are external from the audio compression device 10. In other words, while described in this disclosure as being performed by a single device, i.e., the audio compression device 10 in the example of FIG. 4A, the techniques may be implemented or otherwise performed by a system comprising multiple devices, where each of these devices may each include one or more of the various components or units described in more detail below. Accordingly, the techniques should not be limited to the example of FIG. 4A.

As shown in the example of FIG. 4A, the audio compression device 10 comprises a time-frequency analysis unit 12, a complex representation unit 14, a spatial analysis unit 16, a positional masking unit 18, a simultaneous masking unit 20, a saliency analysis unit 22, a zero order quantization unit 24, a spherical harmonic coefficient (SHC) quantization unit 26, and a bitstream generation unit 28. The time-frequency analysis unit 12 may represent a unit configured to perform a time-frequency analysis of spherical harmonic coefficients (SHC) 11A in order to transform the SHC 11A from the time domain to the frequency domain. The time-frequency analysis unit 12 may output the SHC 11B, which may denote the SHC 11A as expressed in the frequency domain. Although described with respect to the time-frequency analysis unit 12, the techniques may be performed with respect to the SHC 11A left in the time domain rather than performed with respect to the SHC 11B as transformed to the frequency domain.

The SHC 11A may refer to one or more coefficients associated with one or more spherical harmonics. These spherical harmonics may be analogous to the trigonometric basis functions of a Fourier series. That is, spherical harmonics may represent the fundamental modes of vibration of a sphere around a microphone similar to how the trigonometric functions of the Fourier series may represent the fundamental modes of vibration of a string. These coefficients may be derived by solving a wave equation in spherical coordinates that involves the use of these spherical harmonics. In this sense, the SHC 11A may represent a two-dimensional (2D) or three dimensional (3D) sound field surrounding a microphone as a series of spherical harmonics with the coefficients denoting the volume multiplier of the corresponding spherical harmonic.

Lower-order ambisonics (which may also be referred to as first-order ambisonics) may encode sound information into four channels denoted W, X, Y and Z. This encoding format is often referred to as a "B-format." The W channel refers to a non-directional mono component of the captured sound signal corresponding to an output of an omnidirectional microphone. The X, Y and Z channels are the directional components in three dimensions. The X, Y and Z channels typically correspond to the outputs of three figure-of-eight microphones, one of which faces forward, another of which faces to the left and the third of which faces upward, respectively. These B-format signals are commonly based on a spherical harmonic decomposition of the soundfield and correspond to the pressure (W) and the three component pressure gradients (X, Y and Z) at a point in space. Together, these four B-format signals (i.e., W, X, Y and Z) approximate the sound field around the microphone. Formally, these B-format signals may express the first-order truncation of the multipole expansion.

Higher-order ambisonics refers to a form of representing a sound field that uses more channels, representing finer modal components, than the original first-order B-format. As a result, higher-order ambisonics may capture significantly more spatial information. The "higher order" in the term "higher order ambisonics" refers to further terms of the multimodal expansion of the function on the sphere in terms of spherical harmonics. Increasing the spatial information by way of higher-order ambisonics may result in a better expression of the captured sound as pressure over a sphere. Using higher order ambisonics to produce the SHC 11A may enable better reproduction of the captured sound by speakers present at the audio decoder.

The complex representation unit 14 represents a unit configured to convert the SHC 11B to one or more complex representations. Alternatively, in implementations where audio compression device 10 does not transform the SHC 11A to the SHC 11B, the complex representation unit 14 may represent a unit configured to generate the respective complex representations from the SHC 11A. In some instances, the complex representation unit 14 may generate the complex representations of the SHC 11A and/or the SHC 11B such that the complex representations include or otherwise provide data pertaining to the radii of the corresponding spheres to which the SHC 11A apply. In examples, the SHC 11A and/or the SHC 11B may correspond to "real" representations of data in a mathematical context, while the complex representations may correspond to complex abstractions of the same data in the mathematical context or mathematical sense. Further details regarding the conversion and use of complex representations in the context of ambisonics and spherical harmonics may be found in "Unified Description of Ambisonics Using Real and Complex Spherical Harmonics" by Mark Poletti, published in the proceedings of the Ambisonics Symposium, Jun. 25-27, 2009, Graz.

For instance, the complex representations may provide the radius of a sphere over which the omnidirectional SHC of the SHC 11A indicates a total energy (e.g., pressure). Additionally, the complex representation unit 14 may generate the complex representations to provide the radius of a smaller sphere (e.g., concentric with the first sphere), within which all or substantially all of the energy of the omnidirectional SHC is contained. By generating the complex representations to indicate the smaller radius, the complex representation unit 14 may enable other components of the audio compression device 10 to perform their respective operations with respect to the smaller sphere.

In other words, the complex representation unit 14 may, by generating radius-based data on the energy of the SHC 11A, potentially simplify one or more operations of the audio compression device 10 and various components thereof. Additionally, the complex representation unit 14 may implement one or more techniques of this disclosure to enable the audio compression device 10 to perform operations using radii of one or more spheres based on which the SHC 11A are derived. This is in contrast to the raw SHC 11A and the SHC 11B expressed in the frequency domain, for both of which, existing devices may only be capable of analyzing or processing with respect to angle data of the corresponding spheres.

The complex representation unit 14 may provide the generated complex representations to the spatial analysis unit 16. The spatial analysis unit 16 may represent a unit configured to perform spatial analysis of the SHC 11A and/or the 11B (collectively, the "SHC 11"). The spatial analysis unit 16 may perform this spatial analysis to identify areas of relative high and low pressure density (often expressed as a function of one or more of azimuth, angle, elevation angle and radius (or equivalent Cartesian coordinates)) in the sound field, analyzing the SHC 11 to identify one or more spatial properties. This spatial analysis unit 16 may perform a spatial or positional analysis by performing a form of beamforming with respect to the SHC, thereby converting the SHC 11 from the spherical harmonic domain to the spatial domain. The spatial analysis unit 16 may perform this beamforming with respect to a set number of point, such as 32, using a T-design matrix or other similar beamforming matrices, effectively converting the SHC from the spherical harmonic domain to 32 discrete points in this example. The spatial analysis unit 16 may then determine the spatial properties based on the spatial domain SHC. Such spatial properties may specify one or more of an azimuth, angle, elevation angle and radius of various portions of the SHC 11 that have certain characteristics. The spatial analysis unit 16 may identify the spatial properties to facilitate audio encoding by the audio compression device 10. That is, the spatial analysis unit 16 may provide the spatial properties, directly or indirectly, to various components of the audio compression device 10, which may be modified to take advantage of psychoacoustic spatial or positional masking and other spatial characteristics of the sound field represented by the SHC 11.

In examples according to this disclosure, the spatial analysis unit 16 may represent a unit configured to perform one or more forms of spatial mapping of the SHC 11A, e.g., using the complex representations provided by the complex representation unit 14. The expressions "spatial mapping" and "positional mapping" may be used interchangeably herein. Similarly, the expressions "spatial map" and "positional map" may be used interchangeably herein. For instance, the spatial analysis unit 16 may perform 3D spatial mapping based on the SHC 11A, using the complex representations. More specifically, the spatial analysis unit 16 may generate a 3D spatial map that indicates areas of a sphere from which the SHC 11A were generated. As one example, the spatial analysis unit 16 may generate data for the surface of the sphere, which may provide the audio compression device 10 and components thereof with angle-based data for the sphere.

Additionally, the spatial analysis unit 16 may use radius information of the complex representations, in order to determine energy distributions within and outside of the sphere. For instance, based on the radii of one or more spheres that are concentric with the current sphere, the spatial analysis unit 16 may determine the 3D spatial map to include data that indicates energy distributions within a current sphere, and concentric sphere(s) that may include or be included in the current sphere. Such a 3D map may enable the audio compression device 10 and components thereof to determine whether the energy of the omnidirectional SHC is concentrated within a smaller concentric sphere, and/or whether energy is excluded from the current sphere but included in a larger concentric sphere. In other words, the spatial analysis unit 16 may generate a 3D spatial map that indicates where energy is, conceptualized using one or more spheres associated with SHC 11A.

Additionally, the spatial analysis unit 16 may generate a 3D spatial map that indicates energy as a function of time. More specifically, the spatial analysis unit 16 may generate a new 3D spatial map (i.e., recreate the 3D spatial map) at various instances. In one implementation, the spatial analysis unit 16 may recreate the 3D spatial map at each frame defined by the SHC 11A. In some examples, the 3D spatial map generated by the spatial analysis unit 16 may represent the energy of the omnidirectional SHC, distributed according to location data provided by one or more of the higher-order SHC.

The spatial analysis unit 16 may provide the generated 3D map(s) and/or other data to the positional masking unit 18. In examples, the spatial analysis unit 16 may provide, to the positional masking unit 18, 3D mapping data that pertains to the higher-order SHC of the SHC 11A. In turn, the positional masking unit 18 may perform positional (or "spatial") analysis based only on the data pertaining to the higher-order SHC, to thereby identify a positional (or "spatial") masking threshold. Additionally, the positional masking unit 18 may enable other components of the audio compression device 10, such as the SHC quantization unit 26, to perform positional masking with respect to the higher-order SHC using the positional masking threshold.

As one example, the positional masking unit 18 may determine a positional masking threshold with respect to the SHC. For instance, positional masking threshold determined by the positional masking unit 18 may be associated with a threshold of perceptibility. More specifically, the positional masking unit 18 may leverage one or more predetermined properties of human hearing and auditory perception (e.g., psychoacoustics) to determine the positional masking threshold. The positional masking unit 18 may determine the positional masking threshold based on psychoacoustic phenomena that cause a hearer to perceive, as a singly-sourced sound, multiple instances of the same or similar sounds. For instance, the positional masking unit 18 may enable other components of the audio compression device 10 to "mask" one or more of the received higher-order SHC, based on other concurrent higher-order SHC that are associated with similar or identical sound properties.

In other words, the positional masking unit 18 may determine the positional masking threshold, thereby enabling other components of the audio compression device 10 to filter the higher-order SHC, removing certain higher-order SHC that may be redundant and/or unperceived by a listener. In this manner, the positional masking unit 18 may enable the audio compression device to reduce the amount of data to be processed and/or generated to form the bitstream 30. By reducing the amount of data that the audio compression device 10 would otherwise be required to process and/or generate, the positional masking unit 18, in conjunction with other components configured to apply the positional masking threshold, may be configured to enhance efficiency of the audio compression techniques described herein. In this manner, the positional masking unit 18 may offer one or more potential advantages, such as enabling the audio compression device 10 to conserve computing resources in generating the bitstream 30, and conserving bandwidth in transmitting the bitstream 30 using reduced amounts of data.

Additionally, the spatial analysis unit 16 may provide data pertaining to the omnidirectional SHC as well as the higher-order SHC to the simultaneous masking unit 20. In turn, the simultaneous masking unit 20 may determine a simultaneous (e.g., time- and/or energy-based) masking threshold with respect to the received SHC. More specifically, the simultaneous masking unit 20 may leverage one or more predetermined properties of human hearing to determine the simultaneous masking threshold.

Additionally, the simultaneous masking unit 20 may enable other components of the audio compression device 10, to use the simultaneous masking threshold to analyze the concurrence (e.g., temporal overlap) of multiple sounds defined by the received SHC. Examples of components of the audio compression device 10 that may use the simultaneous masking threshold include the zero order quantization unit 24 and the SHC quantization unit 26. If the zero order quantization unit 24 and/or the SHC quantization unit 26 detect concurrent portions of the defined sounds, then zero order quantization unit 24 and/or the SHC quantization unit 26 may analyze the energy and/or other properties (e.g., sound amplitude, pitch, or frequency) of the concurrent sounds, to determine whether one or more of the concurrent portions meets the simultaneous masking threshold determined by the simultaneous masking unit 20.

More specifically, the simultaneous masking unit 20 may determine the simultaneous masking threshold based on the predetermined properties of human hearing, such as the so-called "drowning out" of one sound by another concurrent sound. In determining the spatial masking threshold, and whether a particular sound meets the threshold, the simultaneous masking unit 20 may analyze the energy and/or other characteristics of the sound, and compare the analyzed characteristics with corresponding characteristics of the concurrent sound. If the analyzed characteristics meet the simultaneous masking threshold, then zero order quantization unit 24 and/or the SHC quantization unit 26 may filter out the SHC corresponding to the drowned-out concurrent sounds, based on a determination that an ultimate hearer may not be able to perceive the drowned-out sound. More specifically, the zero order quantization unit 24 and/or the SHC quantization unit 26 may allot less bits, or no bits at all, to one or more of the drowned-out portions.

In other words, the zero order quantization unit 24 and/or the SHC quantization unit 26 may perform simultaneous masking to filter the received SHC, removing certain SHC that may be unperceivable to a listener. In this manner, the simultaneous masking unit 20 may enable the audio compression device 10 to reduce or the amount of data to be processed and/or generated in generating the bitstream 30. By reducing the amount of data that the audio compression device 10 would otherwise be required to process and/or generate, the simultaneous masking unit 20 may be configured to enhance efficiency of the audio compression techniques described herein. In this manner, the simultaneous masking unit 20 may, in conjunction with the zero order quantization unit 24 and/or the SHC quantization unit 26, offer one or more potential advantages, such as enabling the audio compression device 10 to conserve computing resources in generating the bitstream 30, and conserving bandwidth in transmitting the bitstream 30 using reduced amounts of data.

In some examples, the positional masking threshold determined by the positional masking unit 18 and the simultaneous masking threshold determined by the simultaneous masking unit 20 may be expressed herein as $mt_p$ (t, f) and $mt_s$ (t, f), respectively. In the functions described above with respect to the positional and simultaneous masking thresholds, 't' may denote a time (e.g., expressed in frames), and 'f' may denote a frequency bin. Additionally, the positional masking unit 18 and the simultaneous masking unit 20 may apply the functions to the (t,f) pair corresponding to a so-called "sweet spot" defined by at least a portion of the received SHC. In some examples, the sweet spot may, for purposes of applying a masking threshold, correspond to a location with respect to speaker configuration where a particular sound quality (e.g., the highest possible quality) is provided to a listener. For instance, the SHC quantization unit 26 may perform the positional masking such that a resulting sound field, while positionally masked, reflects high quality audio from the perspective of a listener positioned at the sweet spot.

The spatial analysis unit 16 may also provide data associated with the higher-order SHC to the saliency analysis unit 22. In turn, the saliency analysis unit 22 may determine the saliency (e.g., "importance") of each higher-order SHC in the full context of the audio data defined by the full set of SHC at a particular time. As one example, the saliency analysis unit 22 may determine the saliency of a particular higher-order SHC value with respect to entirety of audio data corresponding to a particular instance in time. A lesser saliency (e.g., expressed as a numerical value) may indicate that the particular SHC is relatively unimportant in the full context of the audio data at the time instance. Conversely, a greater saliency, as determined by the saliency analysis unit 22, may indicate that the particular SHC is relatively important in the full context of the audio data at the time instance.

In this manner, the saliency analysis unit 22 may enable the audio compression device 10, and components thereof, to process various SHC values based on their respective saliency with respect to the time at which the corresponding audio occurs. As an example of the potential advantages offered by functionalities implemented by the saliency analysis unit 22, the audio compression device may 10 may determine whether or not to process certain SHC values, or particular ways in which to process certain SHC values, based on the saliency of each SHC value as assigned by the saliency analysis unit 22. The audio compression device 10 may be configured to generate bitstreams that reflect these potential advantages in various scenarios, such as scenarios in which the audio compression device 10 has limited computing resources to expend, and/or has limited network bandwidth over which to signal bitstream 30.

The saliency analysis unit 22 may provide the saliency data corresponding to the higher-order SHC to the SHC quantization unit 26. Additionally, the SHC quantization unit 26 may receive, from the positional masking unit 18 and the simultaneous masking unit 20, the respective $mt_p$ (t, f) and $mt_s$ (t, f) data. In turn, the SHC quantization unit 26 may apply certain portions, or all of, the received data to quantize the SHC. In some implementations, the SHC quantization unit 26 may quantize the SHC by applying a bit-allocation mechanism or scheme. Quantization, such as the quantization described herein with respect to the SHC quantization unit 26, may be one example of a compression techniques, such as audio compression.

As one example, when the SHC quantization unit 26 determines that a particular SHC value has substantially no saliency with respect to the current audio data, the SHC quantization unit 26 may drop the SHC value (e.g., by assigning zero bits to the SHC with regard to bitstream 30). Similarly, the SHC quantization unit 26 may implement the bit-allocation mechanism based on whether or not particular SHC values meet one or both of the positional and simultaneous masking thresholds with respect to concurrent SHC values.

In this manner, the SHC quantization unit 26 may implement the techniques of this disclosure to allocate portions of bitstream 30 (e.g., based on the bit-allocation mechanism) to particular SHC values based on various criteria, such as the saliency of the SHC values, as well as determinations as to whether the SHC values meet particular masking thresholds with respect to concurrent SHC values. By allocating portions of bitstream 30 to particular SHC values based on the bit-allocation mechanism, the SHC quantization unit 26 may quantize or compress the SHC data. By quantizing the SHC data in this manner, the SHC quantization unit 26 may determine which SHC values to send as part of bitstream 30, and/or at what level of accuracy to send the SHC values (e.g., with quantization being inversely proportional to the accuracy). In this manner, the SHC quantization unit 26 may implement the techniques of this disclosure to more efficiently signal bitstream 30, potentially conserving computing resources and/or network bandwidth, while maintaining the sound quality of audio data based on saliency and masking-based properties of particular portions of the audio data.

Using the positional masking threshold received from the positional masking unit 18, the SHC quantization unit 26 may perform positional masking by leveraging tendencies of the human auditory system to mask neighboring spatial portions (or 3D segments) of the sound field when a high acoustic energy is present in the sound field. That is, the SHC quantization unit 26 may determine that high energy portions of the sound field may overwhelm the human auditory system such that portions of energy (often, adjacent areas of relatively lower energy) are unable to be detected (or discerned) by the human auditory system. As a result, the SHC quantization unit 26 may allow lower number of bits (or equivalently, higher quantization noise) to represent the sound field in these so-called "masked" segments of space, where the human auditory systems may be unable to detect (or discern) sounds when high energy portions are detected in neighboring areas of the sound field defined by the SHC 11. This is similar to representing the sound field in those "masked" spatial regions with lower precision (meaning possibly higher noise). More specifically, the SHC quantization unit 26 may determine that one or more of the SHC 11 are positionally masked, and in response, may allot less bits, or no bits at all, to the masked SHC. In this manner, the SHC quantization unit 26 may use the positional masking threshold received from the positional masking unit 18 to leverage human auditory characteristics to more efficiently allot bits to the SHC 11. Thus, the SHC quantization unit 26 may enable the bitstream generation unit 28 to generate the bitstream 30 to accurately represent a sound field as a listener would perceive the sound field, while reduce the amount of data to be processed and/or signaled.

It will be appreciated that, in various instances, the SHC quantization unit 26 may perform positional masking with respect to only higher-order SHC, and may not use the omnidirectional SHC (which may refer to the zero-ordered SHC) in the positional masking operation(s). As described, the SHC quantization unit 26 may perform the positional masking using position-based or location-based attributes of multiple sound sources. As the omnidirectional SHC specifies only energy data, without position-based distribution context, the SHC quantization unit 26 may not be configured to use the omnidirectional SHC in the positional masking process. In other examples, the SHC quantization unit 26 may indirectly use the omnidirectional SHC in the positional masking process, such as by dividing one or more of the received higher-order SHC by the energy value (or "absolute value") defined by the omnidirectional SHC, thereby, deriving specific energy and directional data pertaining to each higher-order SHC.

In some examples, the SHC quantization unit 26 may receive the simultaneous masking threshold from the simultaneous masking unit 20. In turn, the SHC quantization unit 26 may compare one or more of SHC 11 (in some instances, including the omnidirectional SHC), to the simultaneous masking threshold, to determine whether particular SHC of SHC are simultaneously masked. Similarly to the application of the positional masking threshold, the SHC quantization unit 26 may use the simultaneous masking threshold to determine whether, and if so, how many, bits to allot to simultaneously masked SHC. In some instances, the SHC quantization unit 26 may add the positional masking threshold and the simultaneous masking threshold to further determine masking of particular SHC. For instance, the SHC quantization unit 26 may assign weights to each of the positional masking threshold and the simultaneous masking threshold, as part of the addition, to generate a weighted sum or, thereby, a weighted average.

Additionally, the simultaneous masking unit 20, may provide the simultaneous masking threshold to the zero order quantization unit 24. In turn, the zero order quantization unit 24 may determine data pertaining to omnidirectional SHC, such as whether it meets the $mt_s$ (t, f) value, by comparing the omnidirectional SHC to the $mt_s$ (t, f) value. More specifically, the zero order quantization unit 24 may determine whether or not the energy value defined by the omnidirectional SHC is perceivable based on human hearing capabilities, e.g., based on whether the energy is simultaneously masked by concurrent omnidirectional SHC. Based on the determination, the zero order quantization unit 24 may quantize or otherwise compress the omnidirectional SHC. As one example, when the zero order quantization unit 24 determines that the audio compression device 10 is to signal the omnidirectional SHC in an uncompressed format, the zero order quantization unit 24 may apply a quantization factor of zero to the omnidirectional SHC.

Both of the zero order quantization unit 24 and the SHC quantization unit 26 may provide the respective quantized SHC values to the bitstream generation unit 28. Additionally, the bitstream generation unit 28 may generate the bitstream 30 to include data corresponding to the quantized SHC received from the zero order quantization unit 24 and the SHC quantization unit 26. Using the quantized SHC values, the bitstream generation unit 28 may generate the bitstream 30 to include data that reflects the saliency and/or masking-properties of each SHC. As described with respect to the techniques above, the audio compression device 10 may generate a bitstream that reflects various criteria, such as radii-based 3D mappings, SHC saliency, and positional and/or simultaneous masking properties of SHC data.

In this way, the techniques may effectively and/or efficiently encode the SHC 11A such that, as described in more detail below, an audio decoding device, such as the audio decompression device 40 shown in the example of FIG. 5, may recover the SHC 11A. The audio compression device 10 may generate the bitstream 30 such that the audio decompression device may render the recovered SHC 11A to be played using speakers arranged in a dense T-design, the mathematical expression is invertible, which means that there is little to no loss of accuracy due to the rendering. By selecting a dense speaker geometry that includes more speakers than commonly present at the decoder, the techniques provide for good re-synthesis of the sound field. In other words, by rendering multi-channel audio data assuming a dense speaker geometry, the recovered audio data includes a sufficient amount of data describing the sound field, such that upon reconstructing the SHC 11A at the audio decompression device 40, the audio decompression device 40 may re-synthesize the sound field having sufficient fidelity using the decoder-local speakers configured in less-than-optimal speaker geometries. The phrase "optimal speaker geometries" may refer to those specified by standards, such as those defined by various popular surround sound standards, and/or to speaker geometries that adhere to certain geometries, such as a dense T-design geometry or a platonic solid geometry.

In some instances, the spatial masking described above may be performed in conjunction with other types of masking, such as simultaneous masking. Simultaneous masking, much like spatial masking, involves the phenomena of the human auditory system, where sounds produced concurrent (and often at least partially simultaneously) to other sounds mask the other sounds. Typically, the masking sound is produced at a higher volume than the other sounds. The masking sound may also be similar to close in frequency to the masked sound. Thus, while described in this disclosure as being performed alone, the spatial masking techniques may be performed in conjunction with or concurrent to other forms of masking, such as the above noted simultaneous masking.

In examples, the audio compression device 10, and/or components thereof, may divide various SHC values, such as all higher-order SHC values, by the omnidirectional SHC, that is, $a_0^0$. For instance, the $a_0^0$ may specify only energy data, while the higher-order SHC may specify only directional information, and not energy data.

Figure 4B:
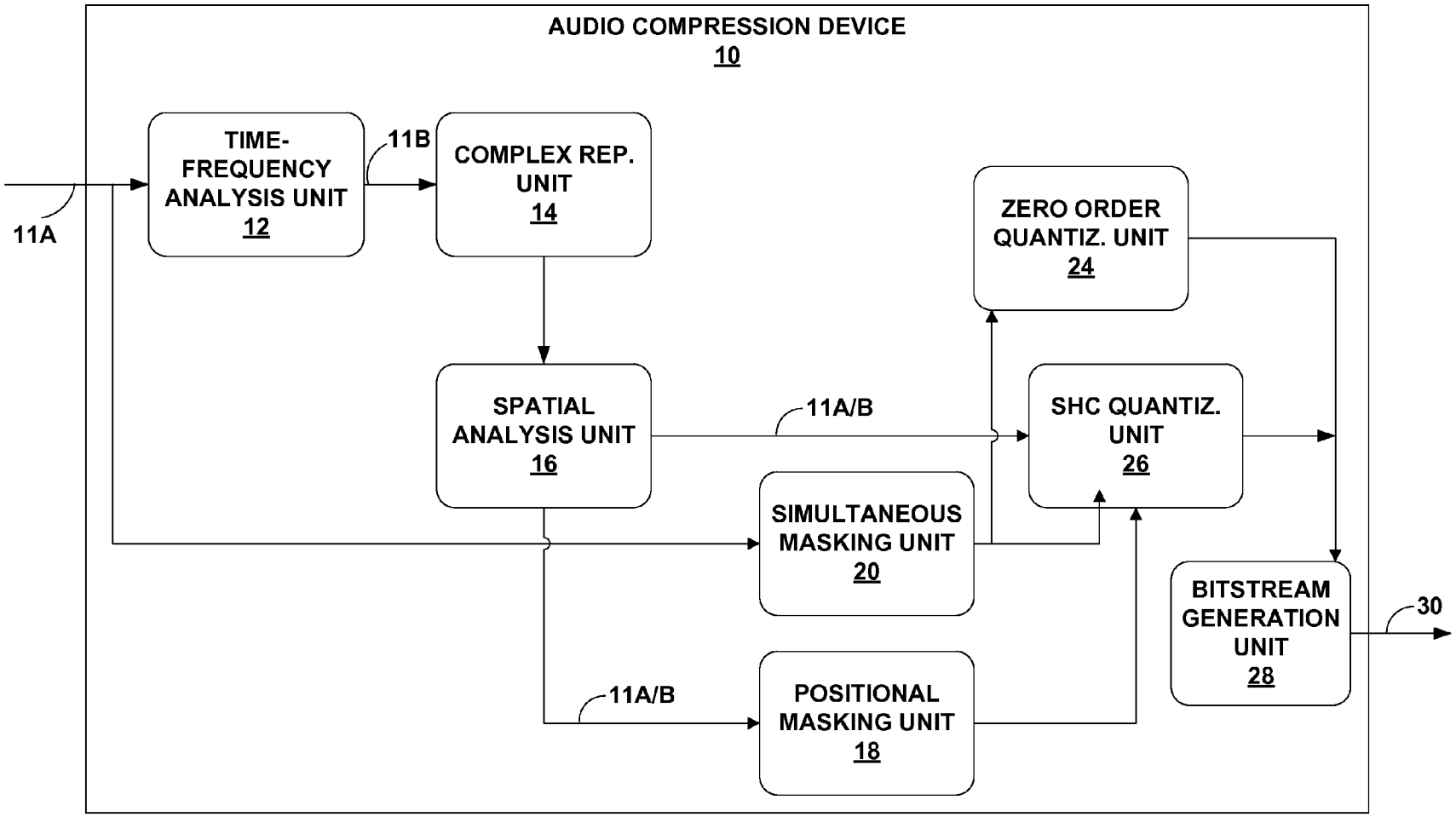

FIG. 4B illustrates an example implementation of the audio compression device 10 that does not include the saliency analysis unit 22.

Figure 4C:
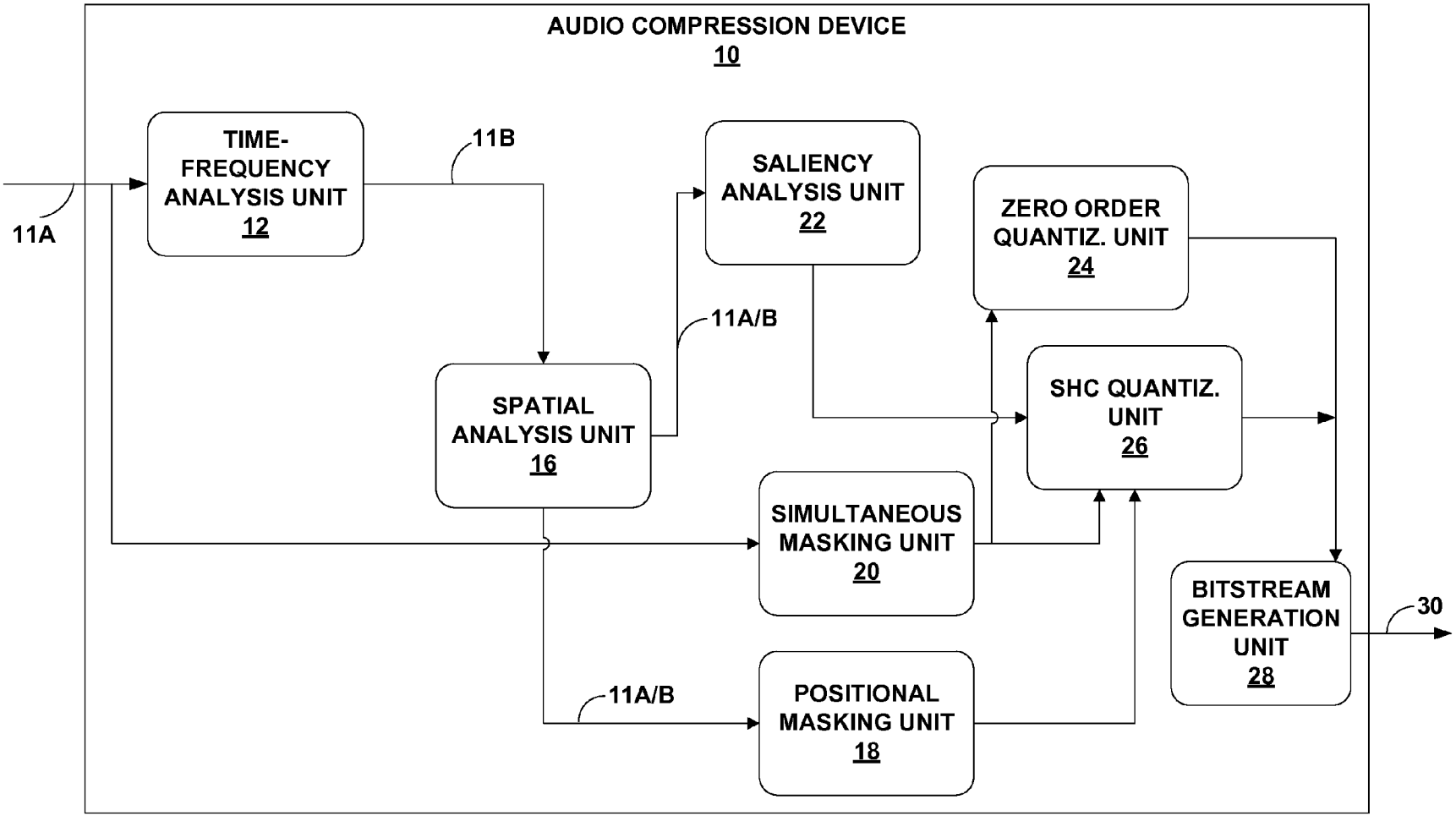

FIG. 4C illustrates an example implementation of the audio compression device 10 that does not include the complex representation unit 14.

Figure 4D:
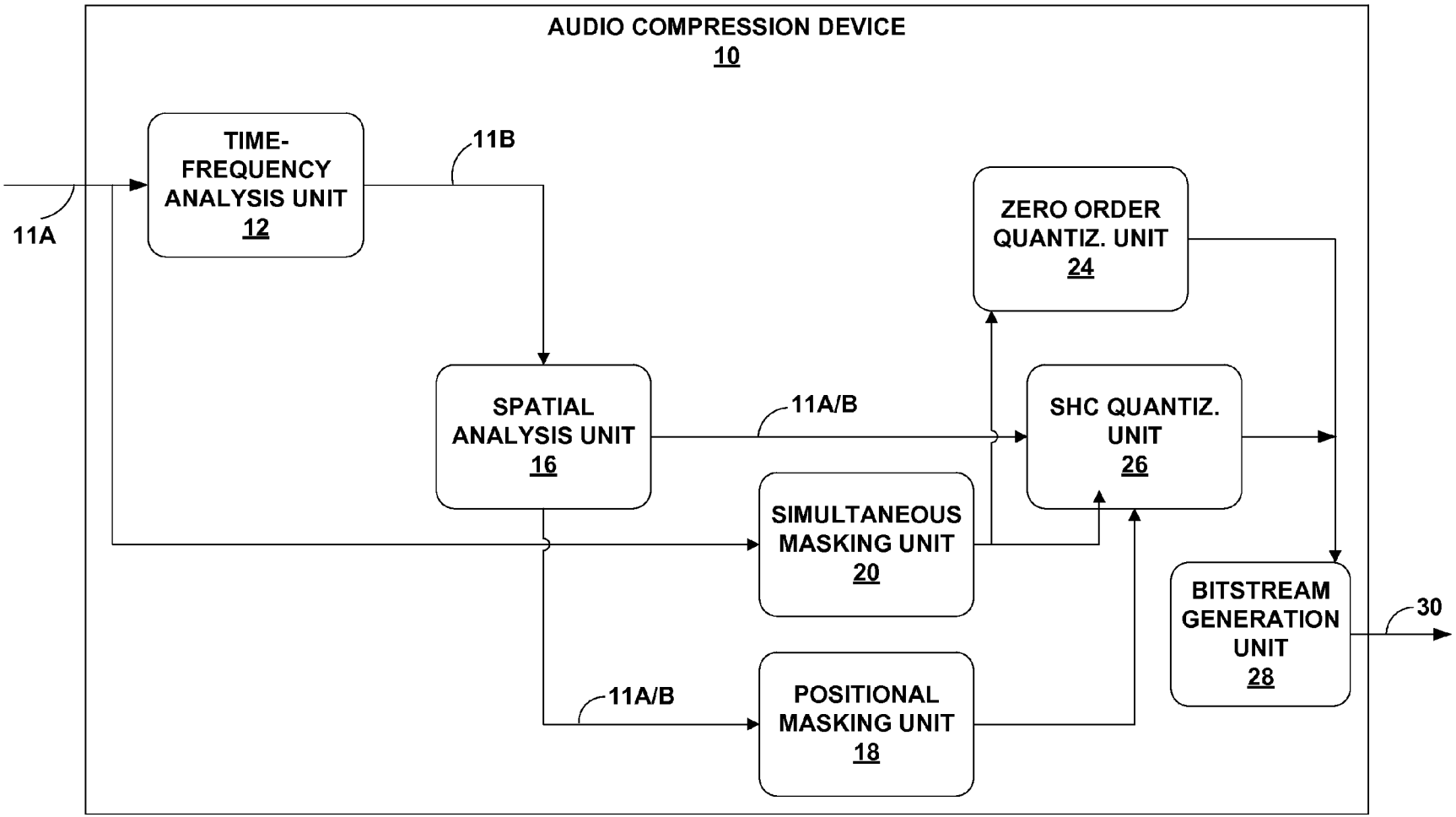

FIG. 4D illustrates an example implementation of the audio compression device 10 that includes neither of the complex representation unit 14 nor the saliency analysis unit 22.

Figure 5:
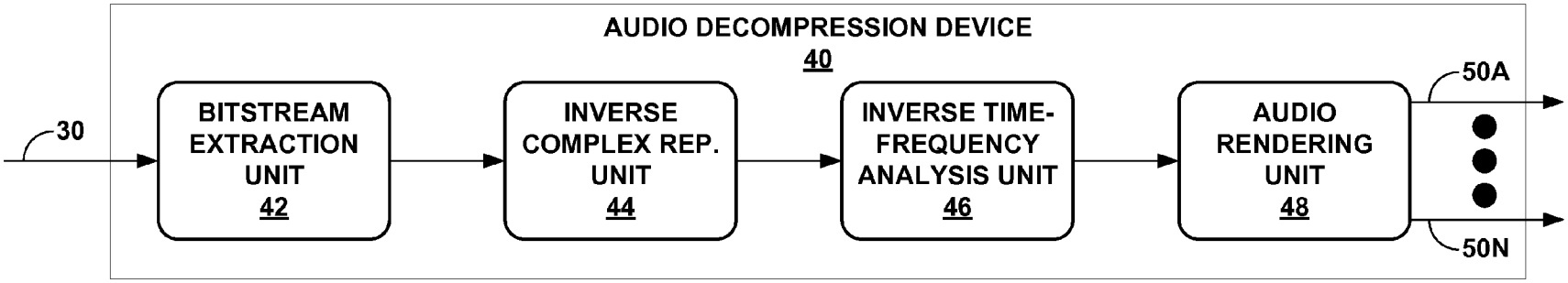
FIG. 5 is a block diagram illustrating an example audio decoding device that may perform various aspects of the techniques described in this disclosure to decode spherical harmonic coefficients describing two or three dimensional sound fields.

FIG. 5 is a block diagram illustrating an example audio decompression device 40 that may perform various aspects of the techniques described in this disclosure to decode spherical harmonic coefficients describing three dimensional sound fields. The audio decompression device 40 generally represents any device capable of decoding audio data, such as a desktop computer, a laptop computer, a workstation, a tablet or slate computer, a dedicated audio recording device, a cellular phone (including so-called "smart phones"), a personal media player device, a personal gaming device, or any other type of device capable of decoding audio data.

Generally, the audio decompression device 40 performs an audio decoding process that is reciprocal to the audio encoding process performed by the audio compression device 10 with the exception of performing spatial analysis and one or more other functionalities described herein with respect to the audio compression device 10, which are typically used by the audio compression device 10 to facilitate the removal of extraneous irrelevant data (e.g., data that would be masked or incapable of being perceived by the human auditory system). In other words, the audio compression device 10 may lower the precision of the audio data representation as the typical human auditory system may be unable to discern the lack of precision in these areas (e.g., the "masked" areas, both in time and, as noted above, in space). Given that this audio data is irrelevant, the audio decompression device 40 need not perform spatial analysis to reinsert such extraneous audio data.

While shown as a single device, i.e., the audio decompression device 40 in the example of FIG. 5, the various components or units referenced below as being included within the audio decompression device 40 may form separate devices that are external from the audio decompression device 40. In other words, while described in this disclosure as being performed by a single device, i.e., the audio decompression device 40 in the example of FIG. 5, the techniques may be implemented or otherwise performed by a system comprising multiple devices, where each of these devices may each include one or more of the various components or units described in more detail below. Accordingly, the techniques should not be limited to the example of FIG. 5.

As shown in the example of FIG. 5, the audio decompression device 40 comprises an bitstream extraction unit 42, an inverse complex representation unit 44, an inverse time-frequency analysis unit 46, and an audio rendering unit 48. The bitstream extraction unit 42 may represent a unit configured to perform some form of audio decoding to decompress the bitstream 30 to recover the SHC 11A. In some examples, the bitstream extraction unit 42 may include modified versions of audio decoders that conform to known spatial audio encoding standards, such as a MPEG SAC or MPEG ACC.

The bitstream extraction unit 42 may represent a unit configured to obtain data, such as quantized SHC data, from the received bitstream 30. In examples, the bitstream extraction unit 42 may provide data extracted from the bitstream 30 to various components of the audio decompression device 40, such as to the inverse complex representation unit 44.

The inverse complex representation unit 44 may represent a unit configured to perform a conversion process of complex representations (e.g., in the mathematical sense) of SHC data to SHC represented in, for example, the frequency domain or in the time domain, depending on whether or not the SHC 11A were converted to SHC 11B at the audio compression device 10. The inverse complex representation unit 44 may apply the inverse of one or more complex representation operations described above with respect to audio compression device 10 of FIG. 4.

The inverse time-frequency analysis unit 46 may represent a unit configured to perform an inverse time-frequency analysis of the spherical harmonic coefficients (SHC) 11B in order to transform the SHC 11B from the frequency domain to the time domain. The inverse time-frequency analysis unit 46 may output the SHC 11A, which may denote the SHC 11B as expressed in the time domain. Although described with respect to the inverse time-frequency analysis unit 46, the techniques may be performed with respect to the SHC 11A in the time domain rather than performed with respect to the SHC 11B in the frequency domain.

The audio rendering unit 60 may represent a unit configured to render the channels 50A-50N (the "channels 50," which may also be generally referred to as the "multi-channel audio data 50" or as the "loudspeaker feeds 50"). The audio rendering unit 60 may apply a transform (often expressed in the form of a matrix) to the SHC 11A. Because the SHC 11A describe the sound field in three dimensions, the SHC 11A represent an audio format that facilitates rendering of the multichannel audio data 50 in a manner that is capable of accommodating most decoder-local speaker geometries (which may refer to the geometry of the speakers that will playback multi-channel audio data 50). Moreover, by rendering the SHC 11A to channels for 32 speakers arranged in a dense T-design at the audio compression device 10, the techniques provide sufficient audio information (in the form of the SHC 11A) at the decoder to enable the audio rendering unit 60 to reproduce the captured audio data with sufficient fidelity and accuracy using the decoder-local speaker geometry. More information regarding the rendering of the multi-channel audio data 50 is described below.

In operation, the audio decompression device 50 may invoke the bitstream extraction unit 42 to decode the bitstream 30 to generate the first multi-channel audio data 50 having a plurality of channels corresponding to speakers arranged in a first speaker geometry. This first speaker geometry may comprise the above noted dense T-design, where the number of speakers may be, as one example, 32. While described in this disclosure as including 32 speakers, the dense T-design speaker geometry may include 64 or 128 speakers to provide a few alternative examples. The audio decompression device 40 may then invoke the inverse complex representation unit 44 to perform an inverse rendering process with respect to generated the first multi-channel audio data 50 to generate the SHC 11B (when the time-frequency transforms is performed) or the SHC 11A (when the time-frequency analysis is not performed). The audio decompression device 40 may also invoke the inverse time-frequency analysis unit 46 to transform, when the time frequency analysis was performed by the audio compression device 10, the SHC 11B from the frequency domain back to the time domain, generating the SHC 11A. In any event, the audio decompression device 40 may then invoke the audio rendering unit 48, based on the encoded-decoded SHC 11A, to render the second multi-channel audio data 40 having a plurality of channels corresponding to speakers arranged in a local speaker geometry.

Figure 6:
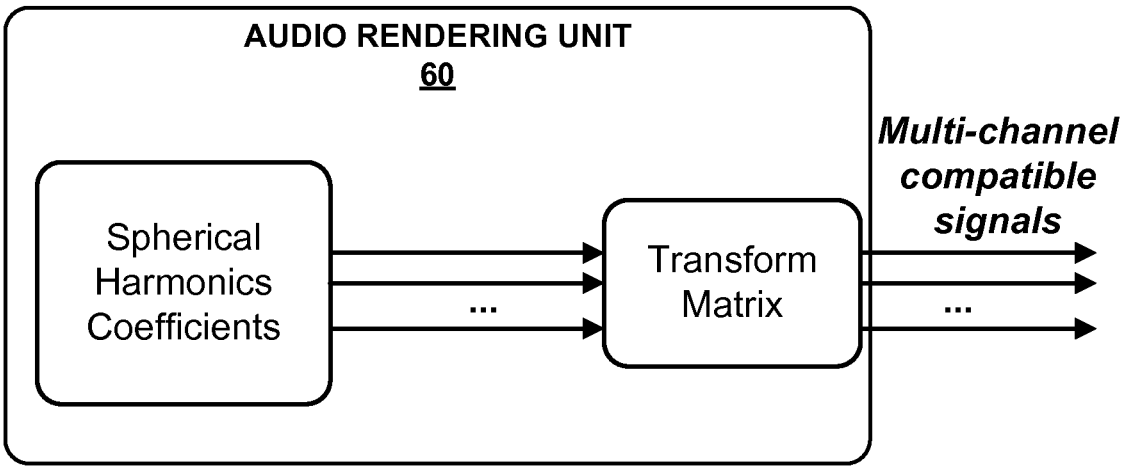
FIG. 6 is a block diagram illustrating the audio rendering unit shown in the example of FIG. 5 in more detail.

FIG. 6 is a block diagram illustrating the audio rendering unit 60 of the bitstream extraction unit 42 shown in the example of FIG. 5 in more detail. Generally, FIG. 6 illustrates a conversion from the SHC 11A to the multi-channel audio data 50 that is compatible with a decoder-local speaker geometry. For some local speaker geometries (which, again, may refer to a speaker geometry at the decoder), some transforms that ensure invertibility may result in less-than-desirable audio-image quality. That is, the sound reproduction may not always result in a correct localization of sounds when compared to the audio being captured. In order to correct for this less-than-desirable image quality, the techniques may be further augmented to introduce a concept that may be referred to as "virtual speakers." Rather than require that one or more loudspeakers be repositioned or positioned in particular or defined regions of space having certain angular tolerances specified by a standard, such as the above noted ITU-R BS.775-1, the above framework may be modified to include some form of panning, such as vector base amplitude panning (VBAP), distance based amplitude panning, or other forms of panning. Focusing on VBAP for purposes of illustration, VBAP may effectively introduce what may be characterized as "virtual speakers." VBAP may generally modify a feed to one or more loudspeakers so that these one or more loudspeakers effectively output sound that appears to originate from a virtual speaker at one or more of a location and angle different than at least one of the location and/or angle of the one or more loudspeakers that supports the virtual speaker.

To illustrate, the following equation for determining the loudspeaker feeds in terms of the SHC may be as follows:

$$\begin{bmatrix} A_0^0(\omega) \\ A_1^1(\omega) \\ A_1^{-1}(\omega) \\ \dots \\ A_{(Order+1)(Order+1)}^{-(Order+1)(Order+1)}(\omega) \end{bmatrix} = -ik \begin{bmatrix} VBAP \\ \text{MATRIX} \\ MxN \end{bmatrix} \begin{bmatrix} D \\ Nx(\text{Order}+1)^2 \end{bmatrix} \begin{bmatrix} g_1(\omega) \\ g_2(\omega) \\ g_3(\omega) \\ \dots \\ g_M(\omega) \end{bmatrix}.$$

In the above equation, the VBAP matrix is of size M rows by N columns, where M denotes the number of speakers (and would be equal to five in the equation above) and N denotes the number of virtual speakers. The VBAP matrix may be computed as a function of the vectors from the defined location of the listener to each of the positions of the speakers and the vectors from the defined location of the listener to each of the positions of the virtual speakers. The D matrix in the above equation may be of size N rows by $(\text{order}+1)^2$ columns, where the order may refer to the order of the SH functions. The D matrix may represent the following $$\text{matrix} \begin{bmatrix} h_0^{(2)}(kr_1)Y_0^{0*}(\theta_1, \varphi_1) & h_0^{(2)}(kr_2)Y_0^{0*}(\theta_2, \varphi_2) & \dots & \dots & \dots \\ h_1^{(2)}(kr_1)Y_1^{1*}(\theta_1, \varphi_1). & \dots & \dots & \dots & \dots \\ \dots & \dots & \dots & \dots & \dots \\ \dots & \dots & \dots & \dots & \dots \\ \dots & \dots & \dots & \dots & \dots \end{bmatrix}.$$

The g matrix (or vector, given that there is only a single column) may represent the gain for speaker feeds for the speakers arranged in the decoder-local geometry. In the equation, the g matrix is of size M. The A matrix (or vector, given that there is only a single column) may denote the SHC 11A, and is of size (Order+1)(Order+1), which may also be denoted as $(\text{Order}+1)^2$.

In effect, the VBAP matrix is an M×N matrix providing what may be referred to as a "gain adjustment" that factors in the location of the speakers and the position of the virtual speakers. Introducing panning in this manner may result in better reproduction of the multi-channel audio that results in a better quality image when reproduced by the local speaker geometry. Moreover, by incorporating VBAP into this equation, the techniques may overcome poor speaker geometries that do not align with those specified in various standards.

In practice, the equation may be inverted and employed to transform the SHC 11A back to the multi-channel feeds 40 for a particular geometry or configuration of loudspeakers, which again may be referred to as the decoder-local geometry in this disclosure. That is, the equation may be inverted to solve for the g matrix. The inverted equation may be as follows:

$$\begin{bmatrix} g_1(\omega) \\ g_2(\omega) \\ g_3(\omega) \\ \cdots \\ g_M(\omega) \end{bmatrix} = -ik \begin{bmatrix} VBAP \\ \text{MATRIX}^{-1} \\ MxN \end{bmatrix} \begin{bmatrix} D^{-1} \\ Nx(\text{Order}+1)^2 \end{bmatrix} \begin{bmatrix} A_0^0(\omega) \\ A_1^1(\omega) \\ A_1^{-1}(\omega) \\ \cdots \\ A_{(Order+1)(Order+1)}^{-(Order+1)(Order+1)}(\omega) \end{bmatrix}.$$

The g matrix may represent speaker gain for, in this example, each of the five loudspeakers in a 5.1 speaker configuration. The virtual speakers locations used in this configuration may correspond to the locations defined in a 5.1 multichannel format specification or standard. The location of the loudspeakers that may support each of these virtual speakers may be determined using any number of known audio localization techniques, many of which involve playing a tone having a particular frequency to determine a location of each loudspeaker with respect to a headend unit (such as an audio/video receiver (A/V receiver), television, gaming system, digital video disc system, or other types of headend systems). Alternatively, a user of the headend unit may manually specify the location of each of the loudspeakers. In any event, given these known locations and possible angles, the headend unit may solve for the gains, assuming an ideal configuration of virtual loudspeakers by way of VBAP.

In this respect, the techniques may enable a device or apparatus to perform a vector base amplitude panning or other form of panning on the plurality of virtual channels to produce a plurality of channels that drive speakers in a decoder-local geometry to emit sounds that appear to originate form virtual speakers configured in a different local geometry. The techniques may therefore enable the bitstream extraction unit 42 to perform a transform on the plurality of spherical harmonic coefficients, such as the SHC 11A, to produce a plurality of channels. Each of the plurality of channels may be associated with a corresponding different region of space. Moreover, each of the plurality of channels may comprise a plurality of virtual channels, where the plurality of virtual channels may be associated with the corresponding different region of space. The techniques may, in some instances, enable a device to perform vector base amplitude panning on the virtual channels to produce the plurality of channel of the multi-channel audio data 40.

Figure 7A:
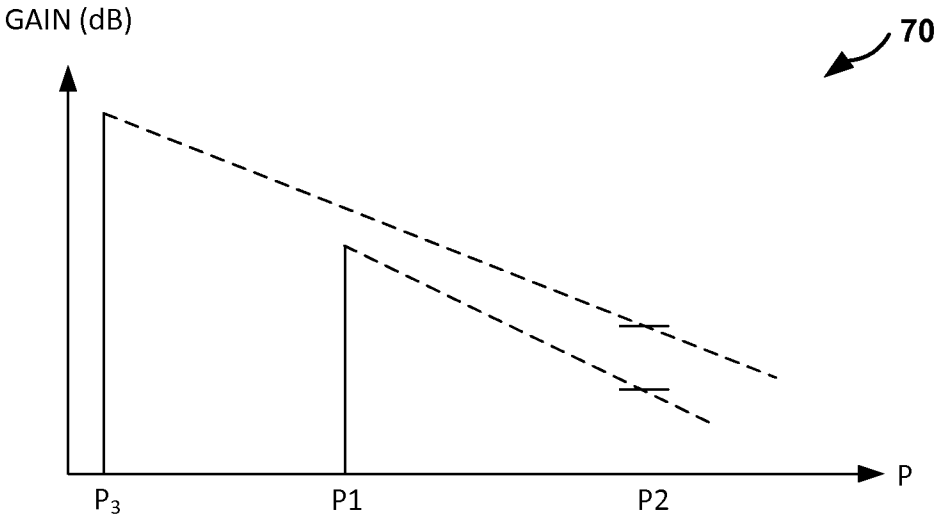
FIGS. 7A and 7B are diagrams illustrating various aspects of the spatial masking techniques described in this disclosure.
Figure 7B:
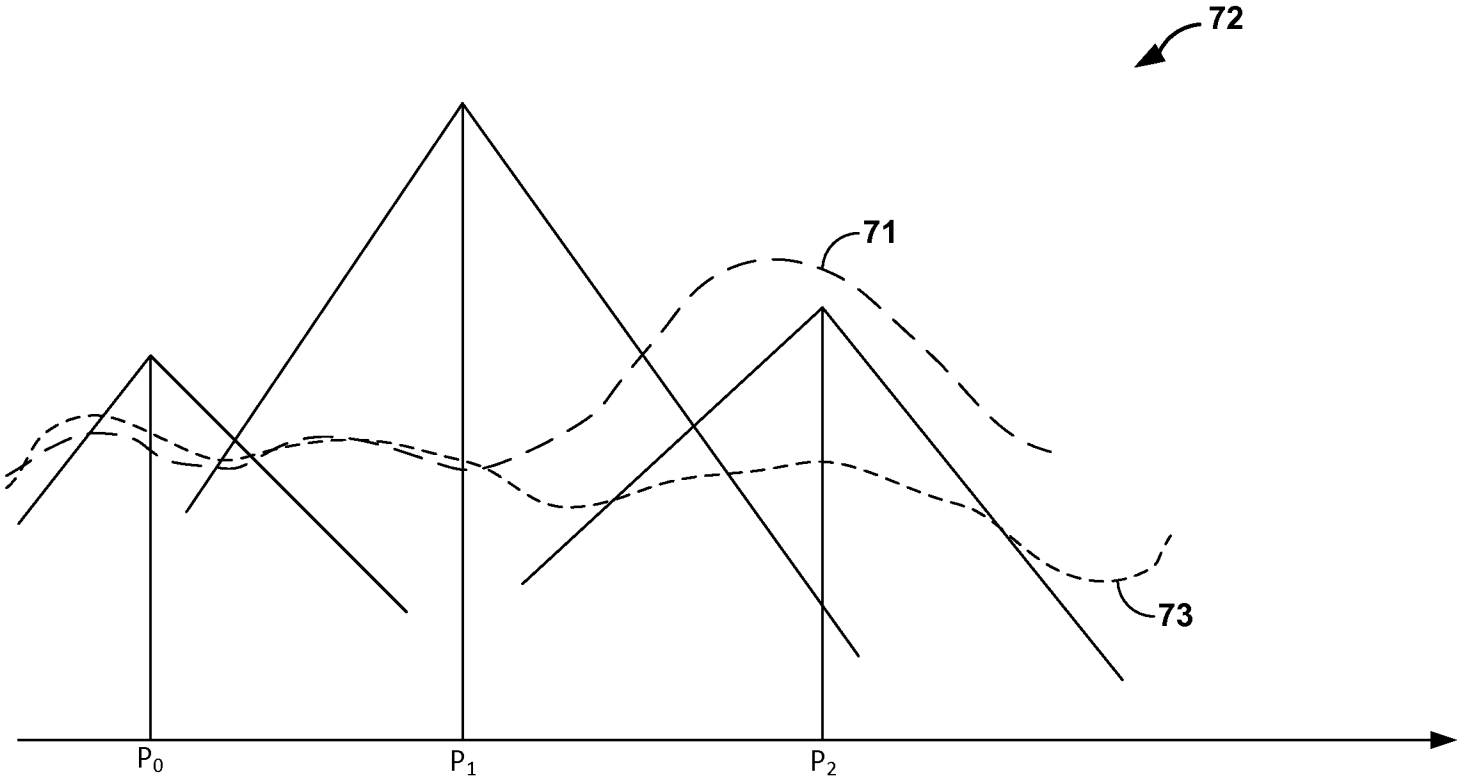

FIGS. 7A and 7B are diagrams illustrating various aspects of the spatial masking techniques described in this disclosure. In the example of FIG. 7A, a graph 70 includes an x-axis denoting points in three-dimensional space within the sound field expressed as SHC. The y-axis of graph 70 denotes gain in decibels. The graph 70 depicts how spatial masking threshold is computed for point two ($P_2$) at a certain given frequency (e.g., frequency $f_1$). The spatial masking threshold may be computed as a sum of the energy of every other point (from the perspective of $P_2$). That is, the dashed lines represent the masking energy of point one ($P_1$) and point three ($P_3$) from the perspective of $P_2$. The total amount of energy may express the spatial masking threshold. Unless $P_2$ has an energy greater than the spatial masking threshold, SHC for $P_2$ need not be sent or otherwise encoded. Mathematically, the spatial masking ($SM_{th}$) threshold may be computed in accordance with the following equation:

$$SM_{th} = \sum_{i=1}^{n} E_{p_i}$$

where $E_{p_i}$ denotes the energy at point $P_i$. A spatial masking threshold may be computed for each point from the perspective of that point and for each frequency (or frequency bin which may represent a band of frequencies).

The spatial analysis unit 16 shown in the example of FIG. 4 may, as one example, compute the spatial masking threshold in accordance with the above equation so as to potentially reduce the size of the resulting bitstream. In some instances, this spatial analysis performed to compute the spatial masking thresholds may be performed with a separate masking block on the channels 50 and provided to one or more components of the audio compression device 10.

FIG. 7B is a diagram illustrating a graph 72 showing a more involved graph than graph 70 in which two different potential masks 71 and 73 are shown. Points $P_0$, $P_1$ and $P_3$ in graph 72 are different spatial points to which the SHC 11 were beamformed. As shown in the example of FIG. 7B, the spatial analysis unit 16 may identify a first mask 71 in which $P_2$ is masked. The spatial analysis unit 16 may, alternatively or in conjunction with identifying the first mask 71, identify a second mask 73, in which case none of the three points, $P_1$-$P_3$, are masked.

While the graphs 70 and 80 depict the dB domain, the techniques may also be performed in the spatial domain (as described above with respect to beamforming). In some examples, the spatial masking threshold may be used with a temporal (or, in other words, simultaneous) masking threshold. Often, the spatial masking threshold may be added to the temporal masking threshold to generate an overall masking threshold. In some instances, weights are applied to the spatial and temporal masking thresholds when generating the overall masking threshold. These thresholds may be expressed as a function of ratios (such as a signal-to-noise ratio (SNR)). The overall threshold may be used by a bit allocator when allocating bits to each frequency bin. The audio compression device 10 of FIG. 4 may represent in one form a bit allocator that allocates bits to frequency bins using one or more of the spatial masking thresholds, the temporal masking threshold or the overall masking threshold.

Figure 8:
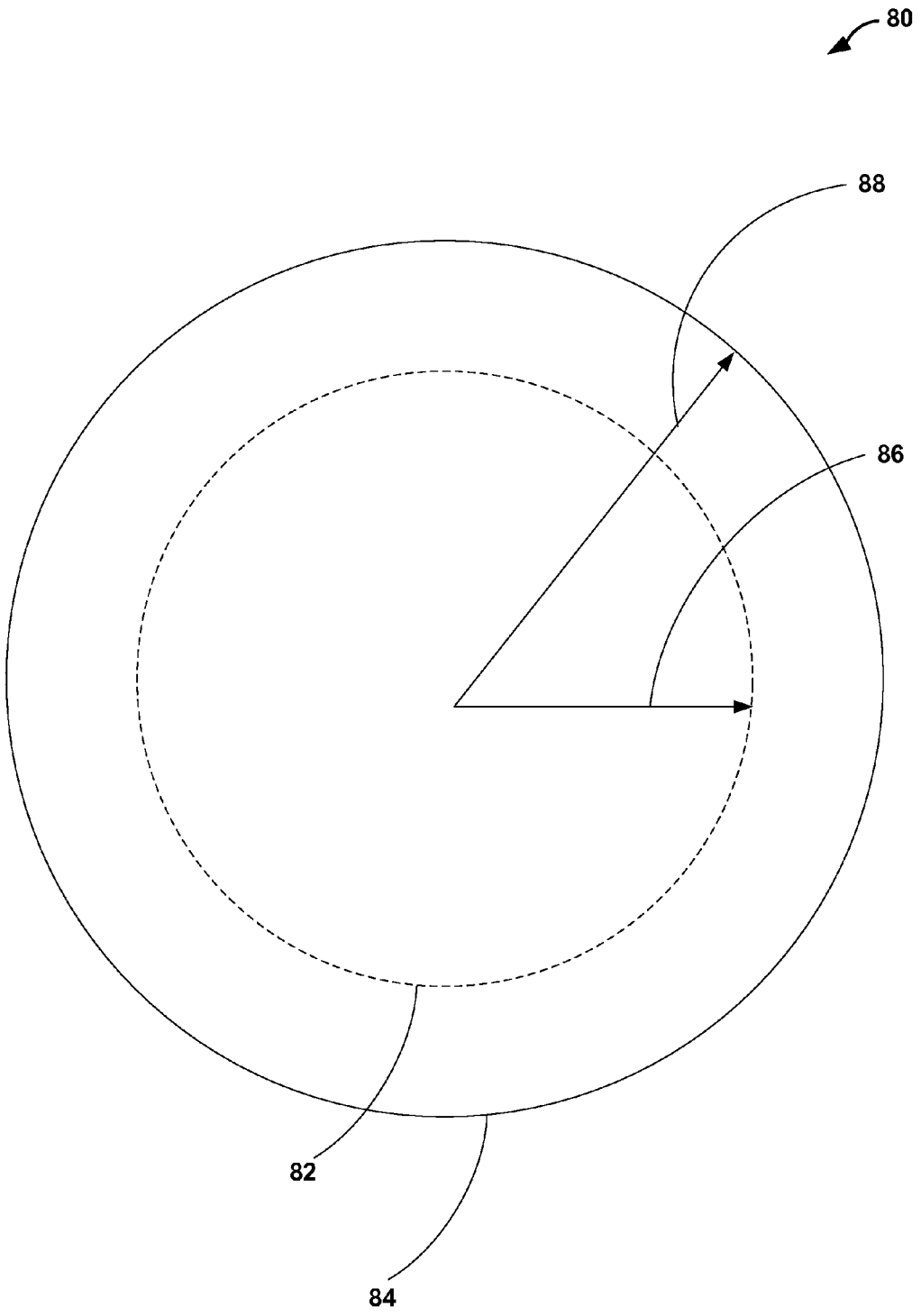
FIG. 8 is a conceptual diagram illustrating an energy distribution, e.g., as may be expressed using omnidirectional SHC.

FIG. 8 is a conceptual diagram illustrating an energy distribution 80, e.g., as may be expressed using an omnidirectional SHC. In the specific example of FIG. 8, the energy distribution 80 may be expressed in terms of two concentric spheres, namely, an inner sphere 82 and an outer sphere 84. In turn, the inner sphere 82 may have a shorter radius 86, while the outer sphere 84 may have a longer radius 88. In examples, the spatial analysis unit 16 of the audio compression device 10 may determine the specific distribution of an absolute energy value defined by the omnidirectional SHC between the inner sphere 82 and the outer sphere 84.

In some scenarios, if the spatial analysis unit 16 determines that all, or the most important portions of the total energy is contained within the inner sphere 82, then the spatial analysis unit 16 may contract or "shrink" the longer radius 88 to the shorter radius 86. In other words, the spatial analysis unit 16 may shrink the outer sphere 84 to form the inner sphere 82, for purposes of determining the absolute value of energy defined by the omnidirectional SHC. By shrinking the outer sphere 84 to form the inner sphere 82 in this way, the spatial analysis unit 16 may enable other components of the audio compression device 10 to perform their respective operations based on the inner sphere 82, thereby conserving computing resources and/or bandwidth consumption caused by transmitting the resulting bitstream 30. It will be appreciated that, even if the shrinking process entails some loss of energy defined by the omnidirectional SHC, the spatial analysis unit 16 may determine that such a loss may be acceptable, for example, in light of the resource and data conservation afforded by shrinking the outer sphere 84 to form the inner sphere 82.

Figure 9A:
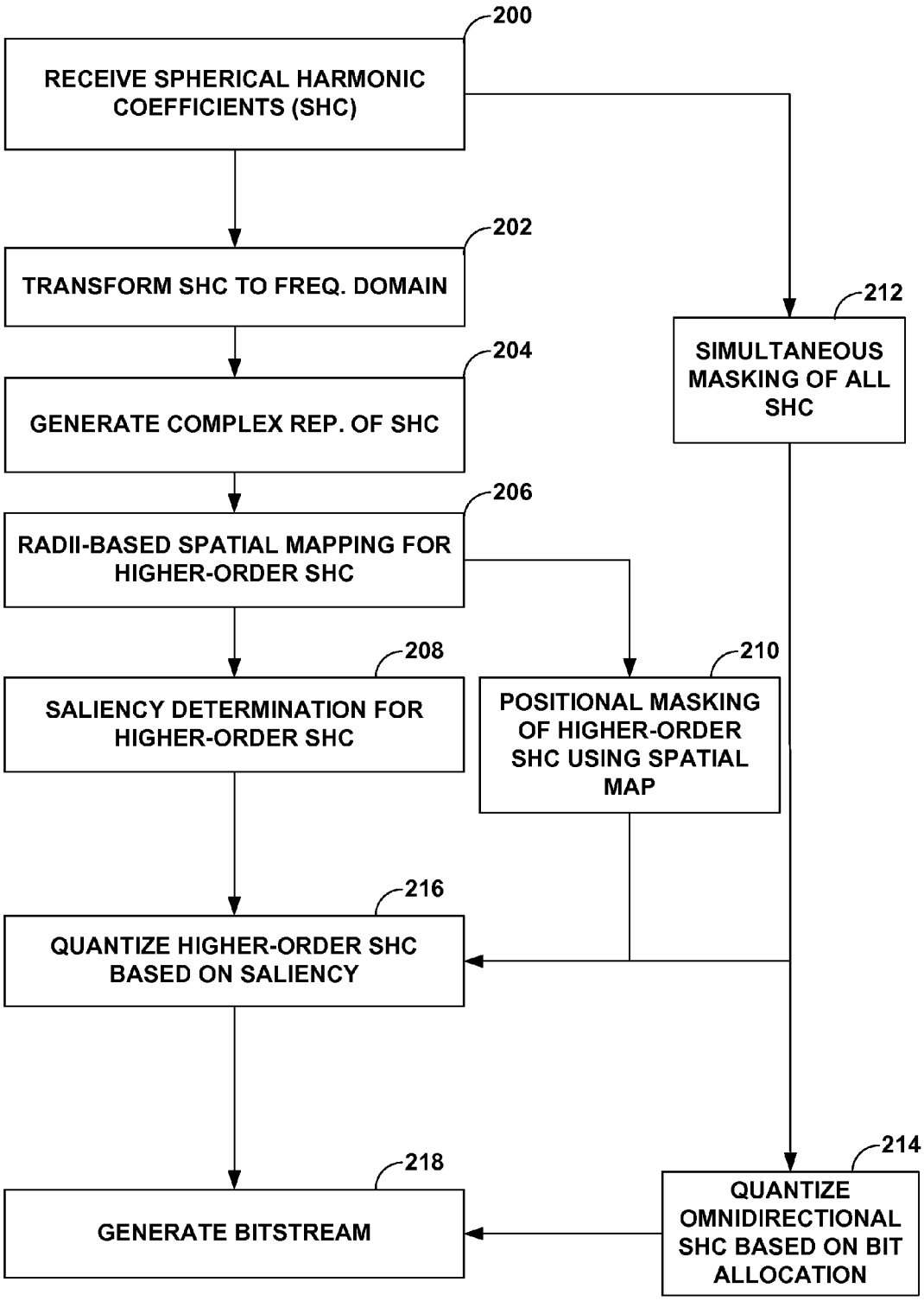
FIGS. 9A and 9B are flowcharts illustrating example processes that may be performed by a device, such as one or more of the audio compression devices of FIGS. 4A-4D, in accordance with one or more aspects of this disclosure.
Figure 9B:
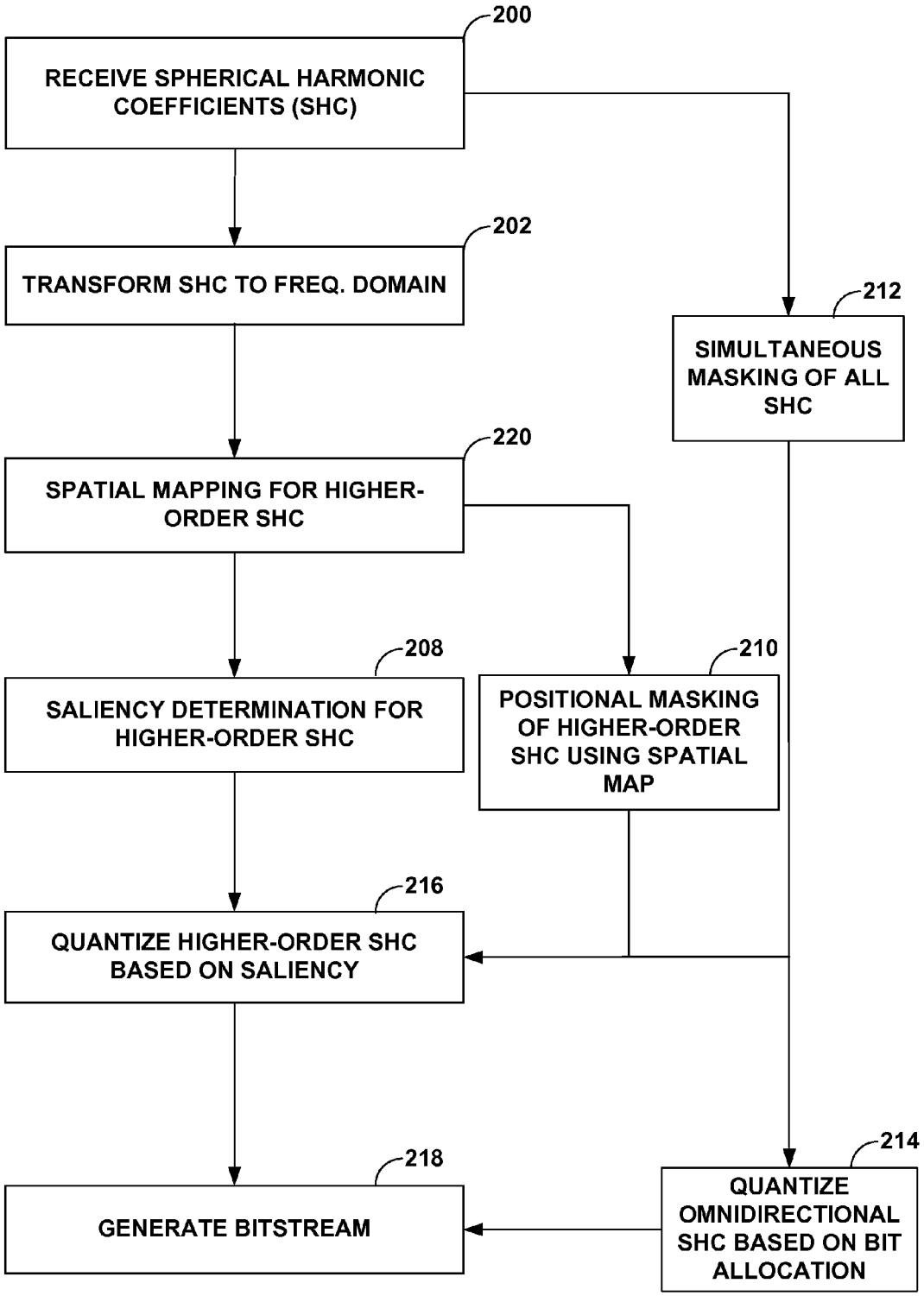

FIGS. 9A and 9B are flowcharts illustrating example processes that may be performed by a device, such as one or more of the implementations of audio compression device 10 illustrated in FIGS. 4A-4D, in accordance with one or more aspects of this disclosure. FIG. 9A is a flowchart illustrating an example process that may be performed by the audio compression device 10, by which the audio compression device 10 receives SHC (200), and transforms the SHC from the spatial domain to the frequency domain (202). The audio compression device 10 may then generate a complex representation of the SHC expressed in the frequency domain (204). In turn, using the complex representations, the audio device 10 may perform radii-based spatial mapping (or radii-based positional mapping) for the higher-order SHC associated with the complex representations (206). It will be appreciated that, in performing the radii-based spatial mapping, the audio compression device may also use characteristics of the SHC as well, to supplement radii-based determinations.

The audio compression device 10 may then perform a saliency determination for the higher-order SHC (e.g., the SHC corresponding to spherical basis functions having an order greater than zero) in the manner described above (208), while also performing a positional masking of these higher-order SHC using a spatial map (210). The audio compression device 10 may also perform a simultaneous masking of the SHC (e.g., all of the SHC, including the SHC corresponding to spherical basis functions having an order equal to zero) (212). The audio compression device 10 may also quantize the omnidirectional SHC (e.g., the SHC corresponding to the spherical basis function having an order equal to zero) based on the bit allocation and the higher-order SHC based on the determined saliency (214, 216). The audio compression device 10 may generate the bitstream to include the quantized omnidirectional SHC and the quantized higher-order SHC (218).

FIG. 9B is a flowchart illustrating an example process that may be performed by the audio compression device 10, by which the audio compression device 10 performs spatial mapping using SHC expressed in the frequency domain. In these examples, the audio compression device 10 may perform the spatial mapping for the higher-order SHC (220) using criteria other than the radii, as, in examples, the radii-based spatial mapping (or radii-based positional mapping) may be dependent on complex representations of the SHC.

Figure 10B:
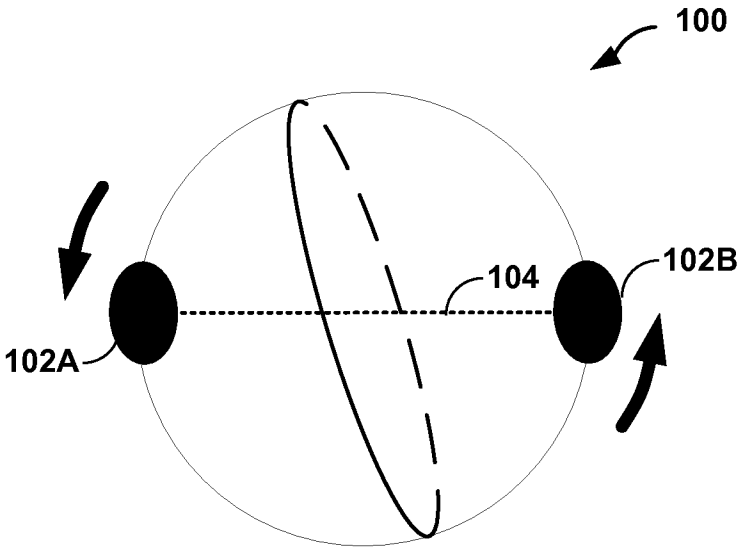
FIGS. 10A and 10B are diagrams illustrating an example of performing various aspects of the techniques described in this disclosure to rotate a sound field 100.
Figure 10A:
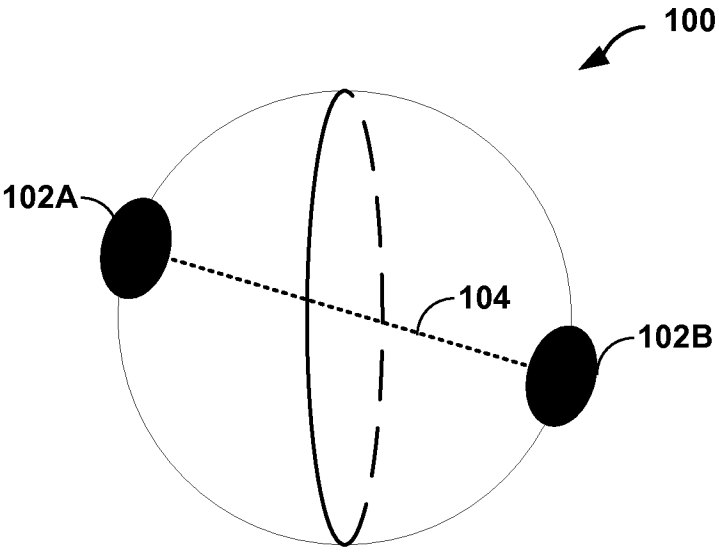

FIGS. 10A and 10B are diagrams illustrating an example of performing various aspects of the techniques described in this disclosure to rotate a sound field 100. FIG. 10A is a diagram illustrating sound field 100 prior to rotation in accordance with the various aspects of the techniques described in this disclosure. In the example of FIG. 10A, the sound field 100 includes two locations of high pressure, denoted as location 102A and 102B. These location 102A and 102B ("locations 102") reside along a line 104 that has a non-zero slope (which is another way of referring to a line that is not horizontal, as horizontal lines have a slope of zero). Given that the locations 102 have a z coordinate in addition to x and y coordinates, higher-order spherical basis functions may be required to correctly represent this sound field 100 (as these higher-order spherical basis functions describe the upper and lower or non-horizontal portions of the sound field. Rather than reduce the sound field 100 directly to SHCs 11, the bitstream generation unit 28 may rotate the sound field 100 until the line 104 connecting the locations 102 is horizontal.

FIG. 10B is a diagram illustrating the sound field 100 after being rotated until the line 104 connecting the locations 102 is horizontal. As a result of rotating the sound field 100 in this manner, the SHC 11 may be derived such that higher-order ones of SHC 11 are specified as zeros given that the rotated sound field 100 no longer has any locations of pressure (or energy) with z coordinates. In this way, the bitstream generation unit 28 may rotate, translate or more generally adjust the sound field 100 to reduce the number of SHC 11 having non-zero values. In conjunction with various other aspects of the techniques, the bitstream generation unit 28 may then, rather than signal a 32-bit signed number identifying that these higher order ones of SHC 11 have zero values, signal in a field of the bitstream 30 that these higher order ones of SHC 11 are not signaled. The bitstream generation unit 28 may also specify rotation information in the bitstream 30 indicating how the sound field 100 was rotated, often by way of expressing an azimuth and elevation in the manner described above. The bitstream extraction device 42 may then imply that these non-signaled ones of SHC 11 have a zero value and, when reproducing the sound field 100 based on SHC 11, perform the rotation to rotate the sound field 100 so that the sound field 100 resembles sound field 100 shown in the example of FIG. 10A. In this way, the bitstream generation unit 28 may reduce the number of SHC 11 required to be specified in the bitstream 30 in accordance with the techniques described in this disclosure.

A 'spatial compaction' algorithm may be used to determine the optimal rotation of the soundfield. In one embodiment, bitstream generation unit 28 may perform the algorithm to iterate through all of the possible azimuth and elevation combinations (i.e., 1024×512 combinations in the above example), rotating the sound field for each combination, and calculating the number of SHC 11 that are above the threshold value. The azimuth/elevation candidate combination which produces the least number of SHC 11 above the threshold value may be considered to be what may be referred to as the "optimum rotation." In this rotated form, the sound field may require the least number of SHC 11 for representing the sound field and can may then be considered compacted. In some instances, the adjustment may comprise this optimal rotation and the adjustment information described above may include this rotation (which may be termed "optimal rotation") information (in terms of the azimuth and elevation angles).

In some instances, rather than only specify the azimuth angle and the elevation angle, the bitstream generation unit 28 may specify additional angles in the form, as one example, of Euler angles. Euler angles specify the angle of rotation about the z-axis, the former x-axis and the former z-axis. While described in this disclosure with respect to combinations of azimuth and elevation angles, the techniques of this disclosure should not be limited to specifying only the azimuth and elevation angles, but may include specifying any number of angles, including the three Euler angles noted above. In this sense, the bitstream generation unit 28 may rotate the sound field to reduce a number of the plurality of hierarchical elements that provide information relevant in describing the sound field and specify Euler angles as rotation information in the bitstream. The Euler angles, as noted above, may describe how the sound field was rotated. When using Euler angles, the bitstream extraction device 42 may parse the bitstream to determine rotation information that includes the Euler angles and, when reproducing the sound field based on those of the plurality of hierarchical elements that provide information relevant in describing the sound field, rotating the sound field based on the Euler angles.

Moreover, in some instances, rather than explicitly specify these angles in the bitstream 30, the bitstream generation unit 28 may specify an index (which may be referred to as a "rotation index") associated with pre-defined combinations of the one or more angles specifying the rotation. In other words, the rotation information may, in some instances, include the rotation index. In these instances, a given value of the rotation index, such as a value of zero, may indicate that no rotation was performed. This rotation index may be used in relation to a rotation table. That is, the bitstream generation unit 28 may include a rotation table comprising an entry for each of the combinations of the azimuth angle and the elevation angle.

Alternatively, the rotation table may include an entry for each matrix transforms representative of each combination of the azimuth angle and the elevation angle. That is, the bitstream generation unit 28 may store a rotation table having an entry for each matrix transformation for rotating the sound field by each of the combinations of azimuth and elevation angles. Typically, the bitstream generation unit 28 receives SHC 11 and derives SHC 11', when rotation is performed, according to the following equation:

$$\begin{bmatrix} SHC \\ 27' \end{bmatrix} = \begin{bmatrix} EncMat_2 \\ (25\times 32) \end{bmatrix} \begin{bmatrix} InvMat_1 \\ (32\times 25) \end{bmatrix} \begin{bmatrix} SHC \\ 27 \end{bmatrix}$$

In the equation above, SHC 11' are computed as a function of an encoding matrix for encoding a sound field in terms of a second frame of reference ($EncMat_2$), an inversion matrix for reverting SHC 11 back to a sound field in terms of a first frame of reference ($InvMat_1$), and SHC 11. $EncMat_2$ is of size 25×32, while $InvMat_2$ is of size 32×25. Both of SHC 11' and SHC 11 are of size 25, where SHC 11' may be further reduced due to removal of those that do not specify salient audio information. $EncMat_2$ may vary for each azimuth and elevation angle combination, while $InvMat_1$ may remain static with respect to each azimuth and elevation angle combination. The rotation table may include an entry storing the result of multiplying each different $EncMat_2$ to $InvMat_1$.

Figure 11:
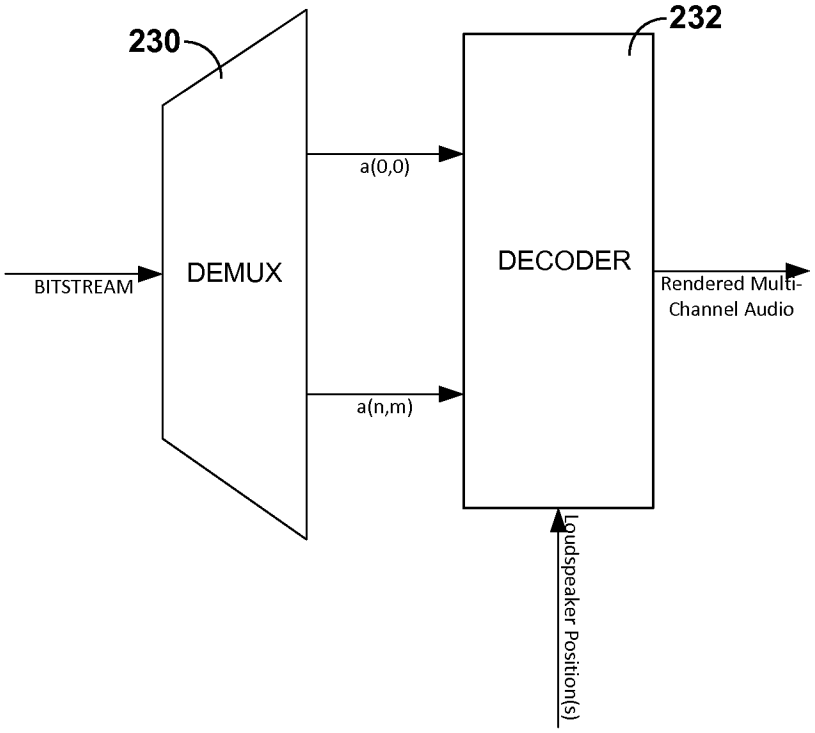
FIG. 11 is an example implementation of a demultiplexer ("demux") that may output the specific SHC from a received bitstream, in combination with a decoder.

FIG. 11 is an example implementation of a demultiplexer ("demux") 230 that may output the specific SHC from a received bitstream, in combination with a decoder 232. In some implementations in accordance with this disclosure, a device may entropy encode b, or optionally, a and b after being multiplexed ("muxed") together.

In one aspect, this disclosure is directed to a method of coding the SHC directly. $a_0^0$ is coded using simultaneous masking thresholds similar to audio coding methods. The rest of the 24 $a_n^m$ coefficients are coded depending on the positional analysis and thresholds. The entropy coder removes redundancy by analyzing the individual and mutual entropy of the 24 coefficients.

Processes are described below specifically with respect to spatial/positional masking in accordance with one or more aspects of this disclosure.

The bandwidth, in terms of bits/second, required to represent 3D audio makes it potentially prohibitive in terms of consumer use. For example, when using a sampling rate of 48 kHz, and with 32 bits/sample resolution, a fourth order SH or HOA representation represents a bandwidth of 36 Mbits/second (25×48000×32 bps). When compared to the state-of-the-art audio coding for stereo signals, which is typically about the 100 kbits/second, this may be considered a large figure. Techniques may therefore be desirable required to reduce the bandwidth of 3D audio representation.

Typically, the two predominant techniques used for bandwidth compressing mono/stereo audio signals—that of taking advantage of psychoacoustic simultaneous masking (removing irrelevant information) and removing redundant information (through entropy coding)—may apply to multichannel/3D audio representations. In addition, spatial audio can take advantage of yet another type of psychoacoustic masking—that caused by spatial proximity of acoustic sources. Sources in close proximity may effectively mask each other more when their relative distances are small compared to when they are spatially further from each other. Techniques described below generally relate to calculating such additional 'masking' due to spatial proximity—when the soundfield representation is in the form of Spherical Harmonic (SH) coefficients (also known as Higher Order Ambisonics—HoA signals). In general, the masking threshold is most easily computed in the acoustic domain—where the masking threshold imposed by an acoustic source tapers or reduces symmetrically as a function of distance from the acoustic source. Applying this tapered function to all acoustic sources—would allow the computation of the 3D 'spatial masking threshold' as a function of space, at one instance of time. Employing this technique to SH/HOA representations would require rendering the SH/HOA signals first to the acoustic domain and then carrying out the spatial masking threshold analysis.

Processes are described herein, which may enable computing the spatial masking threshold directly from the SH coefficients (SHC). In accordance with the processes, the spatial masking threshold may be defined in the SH domain. In other words, in calculating and applying the spatial masking threshold according to the techniques, rendering of SHC from the spherical domain to the acoustic domain may not be necessary. Once the spatial masking threshold is computed, it may be used in multiple ways. As one example, an audio compression device, such as the audio compression device 10 of FIG. 4 or component(s) thereof, may use the spatial masking threshold to determine which of the SHC are irrelevant, e.g., based on predetermined human hearing properties and/or psychoacoustics. As another example, the audio compression device 10 may append the spatial masking threshold to the simultaneous masking threshold through use of an audio bandwidth compression engine (such as MPEG-AAC), to reduce the number of bits required to represent the coefficients even further.

In some examples, the audio compression device may compute the spatial masking threshold using a combination of offline computation and real-time processing. In the offline computation phase, simulated position data are expressed in the acoustic domain by using a beamforming type renderer, where the number of beams is greater than or equal to $(N+1)^2$ (which may denote the number of SHC). This is followed by a spatial masking analysis, which comprises of a tapered spatial 'smearing' function. This spatial smearing function may be applied to all of the beams determined at the previous stage of the offline computation. This is further processed (in effect, an inverse beamforming process), to convert the output of the previous stage to the SH domain. The SH function that relates the original SHC to the output of the previous stage, may define the equivalent of the spatial masking function in the SH domain. This function can now be used in the real-time processing to compute the 'spatial masking threshold' in the SH domain.

The processes described below may provide one or more potential advantages. Examples of such potential advantages include no requirement to convert SH coefficients to the acoustic domain. Thus there is no requirement to retrieve the SH signals from the acoustic domain at the renderer. Besides complexity, the process of converting SH coefficients to the acoustic domain and back to the SH domain may be prone to errors. Also, typically a greater than $(N+1)^2$ acoustic signals/channels are required to minimize the conversion process, meaning that a greater number of raw channels are involved, increasing the raw bandwidth even more. For example, for a 4th order SH representation, 32 acoustic channels (in a T-design geometry) may be required, making the problem of reducing the bandwidth even more difficult. Another example may be that the spreading process in the acoustic domain is reduced to a less computationally expensive multiplicative process in the SH domain.

Figure 12:
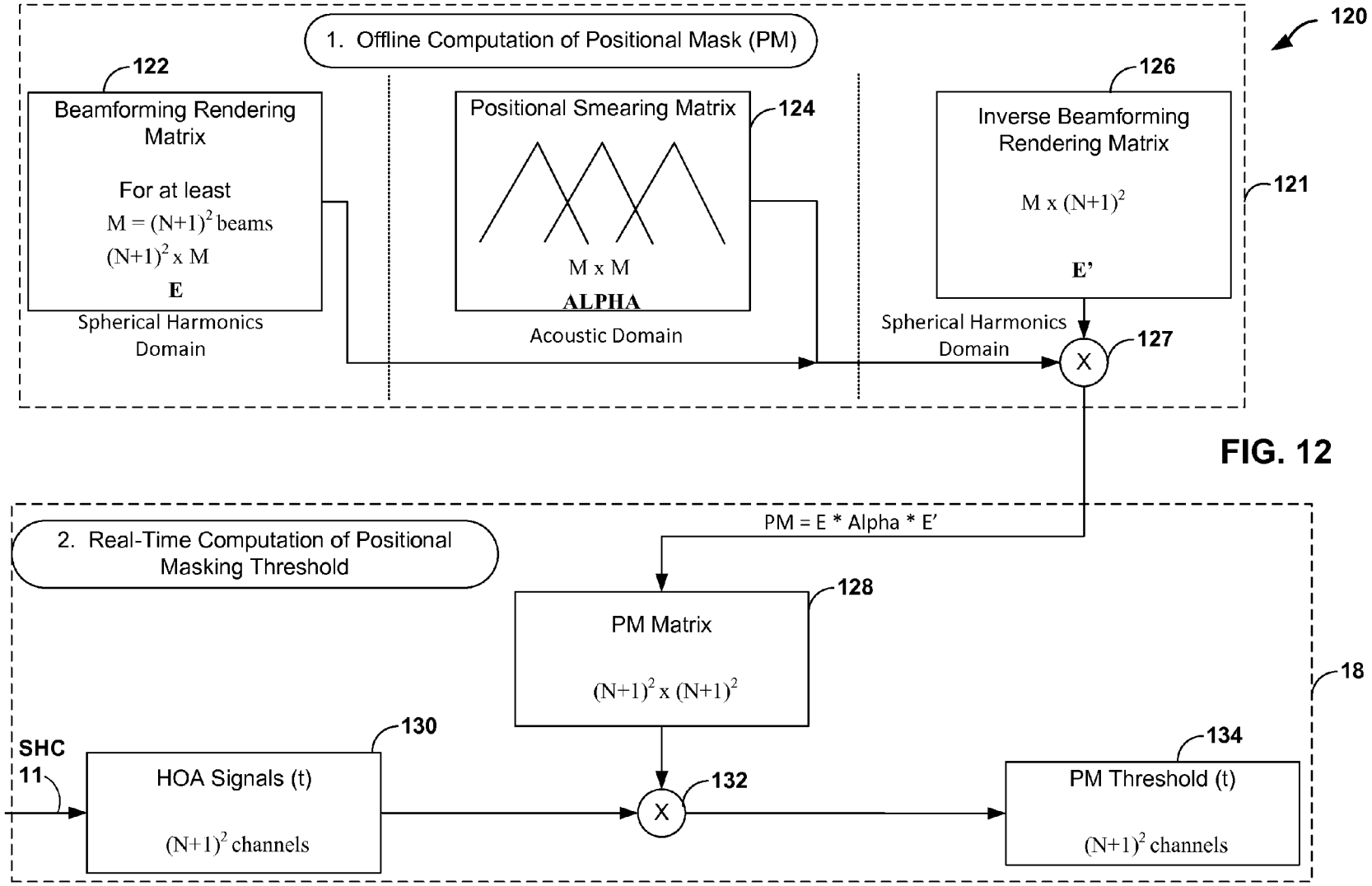
FIG. 12 is a block diagram illustrating an example system configured to perform spatial masking, in accordance with one or more aspects of this disclosure.

FIG. 12 is a block diagram illustrating an example system 120 configured to perform positional masking, in accordance with one or more aspects of this disclosure. As described, the terms "positional masking" and "spatial masking" may be used interchangeably herein. In general, the positional masking process of the system 120 may be expressed as two separate portions, namely, an offline computation of a positional masking (PM) matrix, and a real-time computation of a positional masking threshold. In the example of FIG. 12, the offline PM matrix computation and the real-time PM threshold computation are illustrated with respect to separate modules. In various implementations, the offline PM matrix computation module and the real-time PM threshold computation module may be included in a single device, such as the audio compression device 10 of FIG. 4. In other implementations, the offline PM matrix computation module and the real-time PM threshold computation module may form portions of separate devices. More specifically, a device or module configured to implement PM threshold calculations, such as the audio compression device 10 of FIG. 4 or more specifically the positional masking unit 18 of the audio compression device 10, may apply the PM matrix generated in the offline computation portion, in real-time, to received SHC, to generate the PM threshold. Although various implementations are possible in accordance with the techniques of this disclosure, for ease of discussion purposes only, the offline PM matrix computation and the real-time PM threshold computation are described herein with respect to an offline computation unit 121 and the positional masking unit 18, respectively. The offline computation unit 121 may be implemented by a separate device, which may be referred to as an "offline computation device."

As part of the offline PM matrix computation, the offline computation unit 121 may invoke the beamforming rendering matrix unit 122 to determine a beamforming rendering matrix. The beamforming rendering matrix unit 122 may determine the beamforming rendering matrix using data that is expressed in the spherical harmonic domain, such as spherical harmonic coefficients (SHC) that are derived from simulated positional data associated with certain predetermined audio data. For instance, the beamforming rendering matrix unit 122 may determine a number of orders, denoted by N, to which the SHC 11 correspond. Additionally, the beamforming rendering matrix unit 122 may determine directional information, such as a number of "beams," denoted by M, associated with positional masking properties of the set of SHC. In some examples, the beamforming rendering matrix unit 122 may associate the value of M with a number of so-called "look directions" defined by the configuration of a spherical microphone array, such as an Eigenmike®. For instance, the beamforming rendering matrix unit 122 may use the number of beams M to determine a number of surrounding directions from an acoustic source in which a sound originating from the acoustic source may cause positional masking. In some examples, the beamforming rendering matrix unit 122 may determine that the number of beams M is equal to 32 so as to correspond to the number of microphones placed in a dense T-design geometry.

In some examples, the beamforming rendering matrix unit 122 may set M at a value that is equal to or greater than $(N+1)^2$. In other words, in such examples, the beamforming rendering matrix unit 122 may determine that the number of beams that define directional information associated with positional masking properties of the SHC is at least equal to the square of the number of orders of the SHC increased by one. In other examples, the beamforming rendering matrix unit 122 may set other parameters in determining the value of M, such as parameters that are not based on the value of N.

Additionally, the beamforming rendering matrix unit 122 may determine that the beamforming rendering matrix has a dimensionality of $M\times(N+1)^2$. In other words, the beamforming rendering matrix unit 122 may determine that the beamforming rendering matrix includes exactly M number of rows, and $(N+1)^2$ number of columns. In examples, as described above, in which the beamforming rendering matrix unit 122 determines that M has a value of at least $(N+1)^2$, the resulting beamforming rendering matrix may include at least as many rows as it includes columns. The beamforming rendering matrix may be denoted by the variable "E."

The offline computation unit 121 may also determine a positional smearing matrix with respect to audio data expressed in the acoustic domain, such as by implementing one or more functionalities provided by a positional smearing matrix unit 124. For instance, the positional smearing matrix unit 124 may determine the positional smearing matrix by applying one or more spectral analysis techniques known in the art to the audio data that is expressed in the acoustic domain. Further details on spectral analysis may be found in Chapter 10 of "DAFX: Digital Audio Effects" edited by Udo Zölzer (published on Apr. 18, 2011).

FIG. 12 illustrates an example in which the positional smearing matrix unit 124 determines the positional smearing matrix with respect to functions plotted substantially as triangles, e.g. tapering plots. More specifically, the upwardly tapering plots illustrated with respect to the positional smearing matrix unit 124 in FIG. 12 may express frequency information with respect to a sound. In the context of positional masking, a greater-frequency associated with a sound may mask a lesser-frequency sound, based on the positional proximity of the respective acoustic sources of the sounds. For instance, a sound that is expressed by coordinates of the peak of one of the triangle-shaped plots may be associated with a greater frequency in comparison with other sounds expressed in the graph. In turn, based on difference in frequency between two such sounds, as well as the positional proximity of the respective acoustic sources of the sounds, the greater-frequency sound may positionally mask the lesser-frequency sound. The gradients of the plots may provide data associated with changes in frequency and/or positional proximities of different sounds.

In other words, the positional smearing matrix unit 124 may determine, based on one or more predetermined properties of human hearing and/or psychoacoustics, that the lesser frequency may not be audible or audibly perceptible to one or more listeners, such as a listener who is positioned at the so-called "sweet spot" when the audio is rendered. As described, the positional smearing matrix unit 124 may use information associated with the positional masking properties of concurrent sounds to potentially reduce data processing and/or transmission, thereby potentially conserving computing resources and/or bandwidth.

In examples, the positional smearing matrix unit 124 may determine the positional smearing matrix to have a dimensionality of M×M. In other words, the positional smearing matrix unit 124 may determine that the positional smearing matrix is a square matrix, i.e., with equal numbers of rows and columns. More specifically, in these examples, the positional smearing matrix may have a number of rows and a number of columns that each equals the number of beams determined with respect to the beamforming rendering matrix generated by the beamforming rendering matrix unit 122. The positional smearing matrix generated by the positional smearing matrix unit 124 may be referred to herein as "α" or "Alpha."

Additionally, the offline computation unit 121 may, as part of the offline computation of the positional masking matrix, invoke an inverse beamforming rendering matrix 126 to determine an inverse beamforming rendering matrix. The inverse beamforming rendering matrix determined by the inverse beamforming rendering matrix unit 126 may be referred to herein as "E prime" or "E'." In mathematical terms, E' may represent a so-called "pseudoinverse" or Moore-Penrose pseudoinverse of E. More specifically, E' may represent a non-square inverse of E. Additionally, the inverse beamforming rendering matrix unit 126 may determine E' to have a dimensionality of $M\times(N+1)^2$, which, in examples, is also the dimensionality of E.

In addition, the offline computation unit 121 may multiply (e.g., via matrix multiplication) the matrices represented by E, α, and E' (127). The product of the matrix multiplication performed at a multiplier unit 127, which may be represented by the function (E*α*E'), may yield a positional mask, such as in the form of a positional masking function or positional masking (PM) matrix. For instance, the offline computation functionalities performed by the offline computation unit 121 may generally be represented by the equation PM=E*α*E', where "PM" denotes the positional masking matrix.

According to various implementations of the techniques described in this disclosure, the offline computation unit 121 may perform the offline computation of PM illustrated in FIG. 12 independently of real-time data that corresponds to a recording or other audio input. For instance, one or more of units 122-126 of the offline computation unit 121 may use simulated data, such as simulated positional data. By using simulated data in the offline computation of PM, the offline computation unit 121 may reduce or eliminate any need to use real-time data, such as SHC, derived from an audio input. In some examples, the simulated data may correspond to predetermined audio data, as the audio data may be perceived at a particular position, based on properties of human hearing capabilities and/or psychoacoustics.

In this way, the offline computation unit 121 may calculate PM without requiring the conversion of real-time data into the spherical harmonic domain (e.g., as may be performed by the beamforming rendering matrix unit 122), then into the acoustic domain (e.g., as may be performed by the positional smearing matrix unit 124), and back into the spherical harmonics domain (e.g., as may be performed by the inverse beamforming rendering matrix unit 126), which may be a taxing procedure in terms of computing resources. Instead, the offline computation unit 121 may generate PM based on a one-time calculation based on the techniques described above, using simulated data, such as simulated positional data associated how certain audio may be perceived by a listener. By calculating PM using the offline computation techniques described herein, the offline computation unit 121 may conserve potentially substantial computing resources that the audio compression device 10 would otherwise expend in calculating the PM based on multiple instances of real-time data. according to various implementations, positional analysis unit 16 may be configurable.

As described, an output or result of the offline computation performed by the offline computation unit 121 may include the positional masking matrix PM. In turn, the positional masking unit 18 may perform various aspects of the techniques described in this disclosure to apply the PM to real-time data, such as the SHC 11, of an audio input, to compute a positional masking threshold. The application of the PM to real-time data is denoted in a lower portion of FIG. 12, identified as real-time computation of a positional masking threshold, and described with respect to the positional masking unit 18 of the audio compression device 10. Additionally, the lower portion of system 120, which is associated with the real-time computation of the positional masking threshold, may represent details of one example implementation of the positional masking unit 18, and other implementations of the positional masking unit 18 are possible in accordance with this disclosure.

More specifically, the positional masking unit 18 may receive, generate, or otherwise obtain the positional masking matrix, e.g., through implementing one or more functionalities provided by a positional masking matrix unit 128. The positional masking matrix unit 128 may obtain the PM based on the offline computation portion described above with respect to the offline computation unit 121. In examples, where the offline computation unit 121 performs the offline computation of the PM as a one-time calculation, the offline computation unit 121 may store the resulting PM to a memory or storage device, such as a memory or storage device (e.g., via cloud computing), that is accessible to the audio compression device 10. In turn, at an instance of performing the real-time computation, the positional masking matrix unit 128 may retrieve the PM, for use in the real-time computation of the positional masking threshold.

In some examples, the positional masking matrix unit 128 may determine that the PM has a dimensionality of $(N+1)^2 \times (N+1)^2$, i.e. that the PM is a square matrix that has a number of rows and a number of columns that each equals the square of the number of orders of the simulated SHC of the offline computation, increased by one. In other examples, the positional masking matrix unit 128 may determine other dimensionalities with respect to the PM, including non-square dimensionalities.

Additionally, the audio compression device 10 may determine one or more SHC 11 with respect to an audio input, such as through implementation of one or more functionalities provided by a SHC unit 130. In examples, the SHC 11, may be expressed or signaled as higher-order ambisonic (HOA) signals, at a time denoted by 't'. The respective HOA signals at a time t may be expressed herein as "HOA signals (t)." In examples, the HOA signals (t) may correspond to particular portions of SHC 11 that correspond to sound data that occurs at time (t), where at least one of the SHC 11 corresponds to a basis function having an order N greater than one. As illustrated in FIG. 12, the positional masking unit 18 may determine the SHC 11 as part of the real-time computation portion of the positional masking process described herein. For instance, the positional masking unit 18 may determine the SHC 11 according to a current time t on an ongoing, real-time basis based on the processed audio input.

In various scenarios, the positional masking unit 18 may determine that the SHC 11, at any given time t in the audio input, are associated with channelized audio corresponding to a total of $(N+1)^2$ channels. In other words, in such scenarios, the positional masking unit 18 may determine that the SHC 11 are associated with a number of channels that equals the square of the number of orders of the simulated SHC used by the offline computation unit 121, increased by one.

Additionally, the positional masking unit 18 may multiply values of the SHC 11 at time t by the PM, such as by using matrix multiplier 132. Based on multiplying the SHC 11 for time t by the PM using matrix multiplier 132, the positional masking unit 18 may obtain a positional masking threshold at time 't', such as through implementing one or more functionalities provided by a PM threshold unit 134. The positional masking threshold at time 't' may be referred to herein as the PM threshold (t) or the $mt_p$ (t, f), as described above with respect to FIG. 4. In examples, the PM threshold unit 134 may determine that the PM threshold (t) is associated with a total of $(N+1)^2$ channels, e.g., the same number of channels as SHC 11 corresponding to time t, from which the PM threshold (t) was obtained.

The positional masking unit 18 may apply the PM threshold (t) to the HOA signals (t) to implement one or more of the audio compression techniques described herein. For instance, the positional masking unit 18 may compare each respective SHC of the SHC 11 to the PM threshold (t), to determine whether or not to include respective signal(s) for each SHC in the audio compression and entropy encoding process. As one example, if a particular SHC of the SHC 11 at time t does not satisfy the PM threshold (t), then the positional masking unit 18 may determine that the audio data for the particular SHC is positionally masked. In other words, in this scenario, the positional masking unit 18 may determine that the particular SHC, as expressed in the acoustic domain, may not be audible or audibly perceptible to a listener, such as a listener positioned at the sweet spot based on a predetermined speaker configuration.

If the positional masking unit 18 determines that the acoustic data indicated by a particular SHC of the SHC 11 is positionally masked and therefore inaudible or imperceptible to a listener, the audio compression device 10 may discard or disregard the signal in the audio compression and/or encoding processes. More specifically, based on a determination by the positional masking unit 18 that a particular SHC is positionally masked, the audio compression device 10 may not encode the particular SHC. By discarding positionally masked SHC of the SHC 11 at a time t based on the PM threshold (t), the audio compression device 10 may implement the techniques of this disclosure to reduce the amount of data to be processed, stored, and/or signaled, while potentially substantially maintaining the quality of a listener experience. In other words, the audio compression device 10 may conserve computing and storage resources and/or bandwidth, while not substantially compromising the quality of acoustic data that is delivered to a listener, such as acoustic data delivered to the listener by an audio decompression and/or rendering device.

In various implementations, the offline computation unit 121 and/or the positional masking unit 10 may implement one or both of a "real mode" and an "imaginary mode" in performing the techniques described herein. For instance, the offline computation unit 121 and/or the positional masking unit 10 may add supplement real mode computations and imaginary mode computations with one another.

Figure 13:
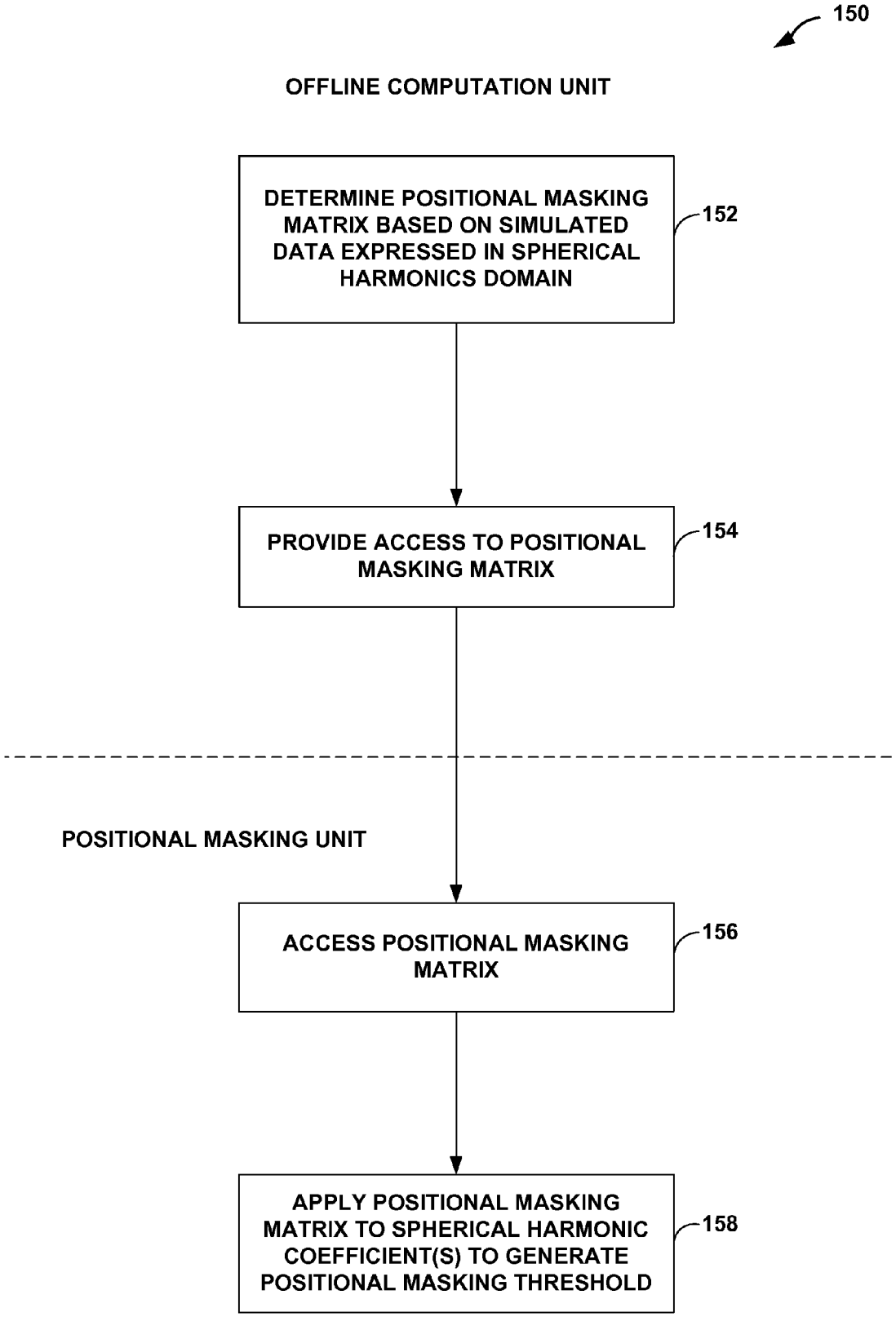
FIG. 13 is a flowchart illustrating an example process that may be performed by one or more devices or components thereof in accordance with one or more aspects of this disclosure.

FIG. 13 is a flowchart illustrating an example process 150 that may be performed by one or more devices or components thereof, such as the offline computation unit 121 of FIG. 12 and the positional masking unit 18 of FIG. 4, in accordance with one or more aspects of this disclosure.

Process 150 may begin when the offline computation unit 121 determines a positional masking matrix based on simulated data expressed in a spherical harmonics domain (152). In examples, the offline computation unit 121 may determine the positional masking matrix at least in part by determining the positional masking matrix as part of an offline computation. For instance, the offline computation may be separate from a real-time computation. In some instances, the offline computation unit 121 may determine the positional masking matrix at least in part by determining a beamforming rendering matrix associated with one or more spherical harmonic coefficients associated with the simulated data, determining a spatial smearing matrix, wherein the spatial smearing matrix includes directional data, and wherein the spatial smearing matrix is expressed in an acoustic domain, and determining an inverse beamforming rendering matrix associated with the one or more spherical harmonic coefficients, wherein the inverse beamforming rendering matrix only includes data expressed in the spherical harmonics domain.

As an example, the offline computation unit 121 may determine the positional masking matrix at least in part by multiplying at least respective portions of the beamforming rendering matrix, the spatial smearing matrix, and the inverse beamforming rendering matrix to form the positional masking matrix. In some examples, the offline computation unit 121 may apply the spatial smearing matrix to data expressed in the acoustic domain at least in part by applying sinusoidal analysis to the data expressed in the acoustic domain. In some examples, each of the beamforming rendering matrix and the inverse beamforming rendering matrix may have a dimensionality of [M by $(N+1)^2$], where M denotes a number of beams and N denotes an order of the spherical harmonic coefficients. For instance, M may have a value that is equal to or greater than a value of $(N+1)^2$. As an example, M may have a value of 32.

In some instances, the offline computation unit 121 may determine the spatial smearing matrix at least in part by determining a tapering positional masking effect associated with the data expressed in the acoustic domain. For example, the tapering positional masking effect may be expressed as a tapering function that is based on at least one gradient variable. Additionally, the offline computation unit 121 provide access to the positional masking matrix (154). As an example, the offline computation unit 121 may load the positional masking matrix to a memory or storage device that is accessible to a device or component configured to use the positional masking matrix in computations, such as the audio compression device 10 or, more specifically, the positional masking unit 18.

The positional masking unit 18 may access the positional masking matrix (156). As examples, the positional masking unit 18 may read one or more values associated with the positional masking matrix from a memory or storage device to which the offline computation unit 121 loaded the value(s). Additionally, the positional masking unit 18 may apply the positional masking matrix to one or more spherical harmonic coefficients to generate a positional masking threshold (158). In examples, the positional masking unit 18 may apply the positional masking matrix to the one or more spherical harmonic coefficients at least in part by applying the positional masking matrix to the one or more spherical harmonic coefficients as part of a real-time computation In some examples, the positional masking unit 18 may divide each spherical harmonic coefficient of the one or more spherical harmonic coefficients having an order greater than zero by an absolute value defined by an omnidirectional spherical harmonic coefficient to form a corresponding directional value for each spherical harmonic coefficient of the plurality of spherical harmonic coefficients having the order greater than zero.

In some instances, the positional masking matrix may have a dimensionality of $[(N+1)^2 \times (N+1)^2]$, where N denotes an order of the spherical harmonic coefficients. As an example, the positional masking unit 18 may apply the positional masking matrix to the one or more spherical harmonic coefficients at least in part by comprises multiplying at least a portion of the positional masking matrix by respective values of the one or more spherical harmonic coefficients. In some examples, the respective values of the one or more spherical harmonic coefficients are expressed as one or more higher-order ambisonic (HOA) signals. In one such example, the one or more HOA signals may include $(N+1)^2$ channels. In one such example, the one or more HOA signals may be associated with a single instance of time.

As an example, the positional masking threshold may be associated with the single instance of time. In some instances, the positional masking threshold may be associated with $(N+1)^2$ channels, where N denotes an order of the spherical harmonic coefficients. In some examples, the positional masking unit 18 may determine whether each of the one or more spherical harmonic coefficients is spatially masked. In one such example, the positional masking unit 18 may determine whether each of the one or more spherical harmonic coefficients is spatially masked at least in part by comparing each of the one or more spherical harmonic coefficients to the positional masking threshold. In some instances, the positional masking unit 18 may, when one of the one or more spherical harmonic coefficients is spatially masked, determine that the spatially masked spherical harmonic coefficient is irrelevant. In one such instance, the positional masking unit 18 may discard the irrelevant spherical harmonic coefficient.

In a first example, the techniques may provide for a method of compressing audio data, the method comprising determining a positional masking matrix based on simulated data expressed in a spherical harmonics domain.

In a second example, the method of the first example, wherein determining the positional masking matrix comprises determining the positional masking matrix as part of an offline computation.

In a third example, the method of the second example, wherein the offline computation being separate from a real-time time computation.

In a fourth example, the method of any of the first through third example or combination thereof, wherein determining the positional masking matrix comprises determining a beamforming rendering matrix associated with one or more spherical harmonic coefficients associated with the simulated data, determining a spatial smearing matrix, wherein the spatial smearing matrix includes directional data, and wherein the spatial smearing matrix is expressed in an acoustic domain, and determining an inverse beamforming rendering matrix associated with the one or more spherical harmonic coefficients, wherein the inverse beamforming rendering matrix only includes data expressed in the spherical harmonics domain.

In a fifth example, the method of the fourth example, wherein determining the positional masking matrix further comprises multiplying at least respective portions of the beamforming rendering matrix, the spatial smearing matrix, and the inverse beamforming rendering matrix to form the positional masking matrix.

In a sixth example, the method of the fourth or fifth example or combinations thereof, further comprising applying the spatial smearing matrix to data expressed in the acoustic domain at least in part by applying sinusoidal analysis to the data expressed in the acoustic domain.

In a seventh example, the method of any of the fourth through sixth example or combinations thereof, wherein each of the beamforming rendering matrix and the inverse beamforming rendering matrix has a dimensionality of $[M \text{ by } (N+1)^2]$, wherein M denotes a number of beams and N denotes an order of the spherical harmonic coefficients.

In an eighth example, the method of the seventh example, wherein M has a value that is equal to or greater than a value of $(N+1)^2$.

In a ninth example, the method of claim eighth example, wherein M has a value of 32.

In a tenth example, the method of any of fourth through ninth example or combinations thereof, wherein determining the spatial smearing matrix comprises determining a tapering positional masking effect associated with the data expressed in the acoustic domain.

In an eleventh example, the method of the tenth example, wherein the tapering positional masking effect is based on a spatial proximity between at least two different portions of the data expressed in the acoustic domain.

In a twelfth example, the method of any of the tenth or eleventh examples or combinations thereof, wherein the tapering positional masking effect is expressed as a tapering function that is based on at least one gradient variable.

In a thirteenth example, the techniques may also provide for a method comprising applying a positional masking matrix to one or more spherical harmonic coefficients to generate a positional masking threshold.

In a fourteenth example, the method of the thirteenth example, wherein applying the positional masking matrix to the one or more spherical harmonic coefficients comprises applying the positional masking matrix to the one or more spherical harmonic coefficients as part of a real-time computation.

In a fifteenth example, the method of any of the thirteenth or fourteenth examples or combinations thereof, further comprising dividing each spherical harmonic coefficient of the one or more spherical harmonic coefficients having an order greater than zero by an absolute value defined by an omnidirectional spherical harmonic coefficient to form a corresponding directional value for each spherical harmonic coefficient of the plurality of spherical harmonic coefficients having the order greater than zero.

In a sixteenth example, the method of any of the thirteenth through fifteenth examples or combinations thereof, wherein the positional masking matrix has a dimensionality of $[(N+1)^2\times(N+1)^2]$, and N denotes an order of the spherical harmonic coefficients.

In a seventeenth example, the method of any of the thirteenth through the sixteenth examples or combinations thereof, wherein applying the positional masking matrix to the one or more spherical harmonic coefficients to generate the positional masking threshold comprises multiplying at least a portion of the positional masking matrix by respective values of the one or more spherical harmonic coefficients.

In an eighteenth example, the method of the seventeenth example, wherein the respective values of the one or more spherical harmonic coefficients are expressed as one or more higher-order ambisonic (HOA) signals.

In a nineteenth example, the method of the eighteenth example, wherein the one or more HOA signals comprise $(N+1)^2$ channels.

In a twentieth example, the method of any of the eighteenth example or the nineteenth example or combinations thereof, wherein the one or more HOA signals are associated with a single instance of time.

In a twenty-first example, the method of any of the thirteenth through twentieth examples or combinations thereof, wherein the positional masking threshold is associated with the single instance of time.

In a twenty-second example, the method of any of the thirteenth through the twenty-first examples or combination thereof, wherein the positional masking threshold is associated with $(N+1)^2$ channels, and N denotes an order of the spherical harmonic coefficients.

In a twenty-third example, the method of any of the thirteenth through twenty-second examples or combination thereof, further comprising determining whether each of the one or more spherical harmonic coefficients is spatially masked.

In a twenty-fourth example, the method of the twenty-third example, wherein determining whether each of the one or more spherical harmonic coefficients is spatially masked comprises comparing each of the one or more spherical harmonic coefficients to the positional masking threshold.

In a twenty-fifth example, the method of any of the twenty-third example, twenty-fourth example or combinations thereof, further comprising, when one of the one or more spherical harmonic coefficients is spatially masked, determining that the spatially masked spherical harmonic coefficient is irrelevant.

In a twenty-sixth example, the method of the twenty-fifth example, further comprising discarding the irrelevant spherical harmonic coefficient.

In a twenty-seventh example, the techniques may further provide for a method of compressing audio data, the method comprising determining a positional masking matrix based on simulated data expressed in a spherical harmonics domain, and applying a positional masking matrix to one or more spherical harmonic coefficients to generate a positional masking threshold.

In a twenty-eighth example, the method of the twenty-seventh example, further comprising the techniques of any of the second example through the twelfth examples, fourteenth through twenty-sixth examples, or combination thereof.

In a twenty-ninth example, the techniques may also provide for a method of compressing audio data, the method comprising determining a radii-based positional mapping of one or more spherical harmonic coefficients (SHC), using one or more complex representations of the SHC.

In a thirtieth example, the method of the twenty-ninth example, wherein the radii-based positional mapping is based at least in part on values of respective radii of one or more spheres represented by the SHC.

In a thirty-first example, the method of the thirtieth example, wherein the complex representations represent the respective radii of the one or more spheres represented by the SHC.

In a thirty-second example, the method of any of the twenty-ninth through thirty-first examples or combination thereof, wherein the complex representations are associated with respective representations of the SHC in a mathematical context.

In a thirty-third example, the techniques may provide for a device comprising a memory, and one or more programmable processors configured to perform the method of any of the first through thirty-second examples or combinations thereof.

In the thirty-fourth example, the device of the thirty-third example, wherein the device comprises an audio compression device.

In the thirty-fifth example, the device of the thirty-third example, wherein the device comprises an audio decompression device.

In a thirty-sixth example, the techniques may also provide for a computer-readable storage medium encoded with instructions that, when executed, cause at least one programmable processor of a computing device to perform the method of any of the first through thirty-second examples or combinations thereof.

In a thirty-seventh example, the techniques may provide for a device comprising one or more processors configured to determine a positional masking matrix based on simulated data expressed in a spherical harmonics domain.

In a thirty-eighth example, the device of the thirty seventh example, wherein the one or more processors are configured to determine the positional masking matrix as part of an offline computation.

In a thirty-ninth example, the device of the thirty-eight example, wherein the offline computation being separate from a real-time time computation.

In a fortieth example, the device of any of the thirty-seventh through thirty-ninth examples or combinations thereof, wherein the one or more processors are configured to determine a beamforming rendering matrix associated with one or more spherical harmonic coefficients associated with the simulated data, determine a spatial smearing matrix, wherein the spatial smearing matrix includes directional data, and wherein the spatial smearing matrix is expressed in an acoustic domain, and determine an inverse beamforming rendering matrix associated with the one or more spherical harmonic coefficients, wherein the inverse beamforming rendering matrix only includes data expressed in the spherical harmonics domain.

In a forty-first example, the device of the fortieth example, wherein the one or more processors are configured to multiply at least respective portions of the beamforming rendering matrix, the spatial smearing matrix, and the inverse beamforming rendering matrix to form the positional masking matrix.

In a forty-second example, the device of any of the fortieth example, forty-first example or combinations thereof, wherein the one or more processors are further configured to apply the spatial smearing matrix to data expressed in the acoustic domain at least in part by applying sinusoidal analysis to the data expressed in the acoustic domain.

In a forty-third example, the device of any of the fortieth through forty-second examples or combinations thereof, wherein each of the beamforming rendering matrix and the inverse beamforming rendering matrix has a dimensionality of [M by $(N+1)^2$], wherein M denotes a number of beams and N denotes an order of the spherical harmonic coefficients.

In a forty-fourth example, the device of the forty-third example, wherein M has a value that is equal to or greater than a value of $(N+1)^2$.

In a forty-fifth example, the device of the forty-forth example, wherein M has a value of 32.

In a forty-sixth example, the device of any of the forty through forty-fourth examples or combinations thereof, wherein the one or more processors are configured to determine a tapering positional masking effect associated with the data expressed in the acoustic domain.

In a forty-seventh example, the device of the forty-sixth example, wherein the tapering positional masking effect is based on a spatial proximity between at least two different portions of the data expressed in the acoustic domain.

In a forty-eighth example, the device of any of the forty-sixth example, the forty-seventh example or combinations thereof, wherein the tapering positional masking effect is expressed as a tapering function that is based on at least one gradient variable.

In a forty-ninth example, the techniques may provide for a device comprising one or more processors configured to apply a positional masking matrix to one or more spherical harmonic coefficients to generate a positional masking threshold.

In a fiftieth example, the device of the forty-ninth example, wherein the one or more processors are configured to apply the positional masking matrix to the one or more spherical harmonic coefficients as part of a real-time computation.

In a fifty-first example, the device of any of the forty-ninth example, the fiftieth example or combination thereof, wherein the one or more processors are further configured to divide each spherical harmonic coefficient of the one or more spherical harmonic coefficients having an order greater than zero by an absolute value defined by an omnidirectional spherical harmonic coefficient to form a corresponding directional value for each spherical harmonic coefficient of the plurality of spherical harmonic coefficients having the order greater than zero.

In a fifty-second example, the device of any of the forty-ninth example through the fifty-first example or combination thereof, wherein the positional masking matrix has a dimensionality of $[(N+1)^2 \times (N+1)^2]$, and N denotes an order of the spherical harmonic coefficients.

In a fifty-third example, the device of any of the forty-ninth through fifty-second examples or combinations thereof, wherein the one or more processors are configured to multiply at least a portion of the positional masking matrix by respective values of the one or more spherical harmonic coefficients.

In a fifty-fourth example, the device of the fifty-third example, wherein the respective values of the one or more spherical harmonic coefficients are expressed as one or more higher-order ambisonic (HOA) signals.

In a fifty-fifth example, the device of the fifty-fourth example, wherein the one or more HOA signals comprise $(N+1)^2$ channels.

In a fifty-sixth example, the device of any of the fifty-fourth example, the fifty-fifth example or combinations thereof, wherein the one or more HOA signals are associated with a single instance of time.

In a fifty-seventh example, the device of any of the forty-ninth example through the fifty-sixth example or combinations thereof, wherein the positional masking threshold is associated with the single instance of time.

In a fifty-eighth example, the device of any of the forty-ninth example through the fifty-seventh example or combinations thereof, wherein the positional masking threshold is associated with $(N+1)^2$ channels, and N denotes an order of the spherical harmonic coefficients.

In a fifty-ninth example, the device of any of forty-ninth example through the fifty-eighth example or combinations thereof, wherein the one or more processors are further configured to determine whether each of the one or more spherical harmonic coefficients is spatially masked.

In a sixtieth example, the device of the fifty-ninth example, wherein the one or more processors are configured to compare each of the one or more spherical harmonic coefficients to the positional masking threshold.

In a sixty-first example, the device of any of the fifty-ninth example, the sixtieth example, or combinations thereof, wherein the one or more processors are further configured to, when one of the one or more spherical harmonic coefficients is spatially masked, determine that the spatially masked spherical harmonic coefficient is irrelevant.

In a sixty-second example, the device of the sixty-first example, wherein the one or more processors are further configured to discard the irrelevant spherical harmonic coefficient.

In a sixty-third example, the techniques may also provide for a device comprising one or more processors configured to determine a positional masking matrix based on simulated data expressed in a spherical harmonics domain, and apply a positional masking matrix to one or more spherical harmonic coefficients to generate a positional masking threshold.

In a sixty-fourth example, the device of the sixty-third example, wherein the one or more processors are further configured to perform the steps of the method recited by any of the first through thirty-fifth examples, or combinations thereof.

In a sixty-fifth example, the techniques may also provide for a device comprising one or more processors configured to determine a radii-based positional mapping of one or more spherical harmonic coefficients (SHC), using one or more complex representations of the SHC.

In a sixty-sixth example, the device of the sixty-fifth example, wherein the radii-based positional mapping is based at least in part on values of respective radii of one or more spheres represented by the SHC.

In a sixty-seventh example, the device of the sixty-sixth example, wherein the complex representations represent the respective radii of the one or more spheres represented by the SHC.

In a sixty-eighth example, the device of any of the sixty-fifth through the sixty-seventh examples or combination thereof, wherein the complex representations are associated with respective representations of the SHC in a mathematical context In a sixty-ninth example, the techniques may further provide for a device comprising means for determining a positional masking matrix based on simulated data expressed in a spherical harmonics domain, and means for storing the positional masking matrix.

In a seventieth example, the device of the sixty-ninth example, wherein the means for determining the positional masking matrix comprises means for determining the positional masking matrix as part of an offline computation.

In a seventy-first example, the device of the seventieth example, wherein the offline computation is separate from a real-time time computation.

In a seventy-second example, the device of any of claims the sixty-ninth through seventy-first examples or combinations thereof, wherein the means for determining the positional masking matrix comprises means for determining a beamforming rendering matrix associated with one or more spherical harmonic coefficients associated with the simulated data, means for determining a spatial smearing matrix, wherein the spatial smearing matrix includes directional data, and wherein the spatial smearing matrix is expressed in an acoustic domain, and means for determining an inverse beamforming rendering matrix associated with the one or more spherical harmonic coefficients, wherein the inverse beamforming rendering matrix only includes data expressed in the spherical harmonics domain.

In a seventy-third example, the device of the seventy-second example, wherein the means for determining the positional masking matrix further comprises means for multiplying at least respective portions of the beamforming rendering matrix, the spatial smearing matrix, and the inverse beamforming rendering matrix to form the positional masking matrix.

In a seventy-fourth example, the device of any of the seventy-second example, the seventy-third example or combinations thereof, further comprising means for applying the spatial smearing matrix to data expressed in the acoustic domain at least in part by applying sinusoidal analysis to the data expressed in the acoustic domain.

In a seventy-fifth example, the device of any of the seventy-second through seventy-fourth examples or combinations thereof, wherein each of the beamforming rendering matrix and the inverse beamforming rendering matrix has a dimensionality of [M by $(N+1)^2$], wherein M denotes a number of beams and N denotes an order of the spherical harmonic coefficients.

In a seventy-sixth example, the device of the seventy-fifth example, wherein M has a value that is equal to or greater than a value of $(N+1)^2$.

In a seventy-seventh example, the device of the seventy-fifth example, wherein M has a value of 32.

In a seventy-eighth example, the device of any of the seventy-second through seventy-sixth examples or combinations thereof, wherein the means for determining the spatial smearing matrix comprises means for determining a tapering positional masking effect associated with the data expressed in the acoustic domain.

In a seventy-ninth example, the device of the seventy-eighth example, wherein the tapering positional masking effect is based on a spatial proximity between at least two different portions of the data expressed in the acoustic domain.

In an eightieth example, the device of any of the seventy-eighth example, the seventy-ninth example, or combinations thereof, wherein the tapering positional masking effect is expressed as a tapering function that is based on at least one gradient variable.

In an eighty-first example, the techniques may moreover provide for a device comprising means for storing spherical harmonic coefficients, and means for applying a positional masking matrix to one or more of the spherical harmonic coefficients to generate a positional masking threshold.

In an eighty-second example, the device of the eighty-first example, wherein the means for applying the positional masking matrix to the one or more spherical harmonic coefficients comprises means for applying the positional masking matrix to the one or more spherical harmonic coefficients as part of a real-time computation.

In an eighty-third example, the device of any of the eighty-first example, the eighty-second example or combinations thereof, further comprising means for dividing each spherical harmonic coefficient of the one or more spherical harmonic coefficients having an order greater than zero by an absolute value defined by an omnidirectional spherical harmonic coefficient to form a corresponding directional value for each spherical harmonic coefficient of the plurality of spherical harmonic coefficients having the order greater than zero.

In an eighty-fourth example, the device of any of the eighty-first through eighty-third examples or combinations thereof, wherein the positional masking matrix has a dimensionality of $[(N+1)^2 \times (N+1)^2]$, and N denotes an order of the spherical harmonic coefficients.

In an eighty-fifth example, the device of any of the eighty-first through eighty-fourth examples or combinations thereof, wherein the means for applying the positional masking matrix to the one or more spherical harmonic coefficients to generate the positional masking threshold comprises means for multiplying at least a portion of the positional masking matrix by respective values of the one or more spherical harmonic coefficients.

In an eighty-sixth example, the device of the eighty-fifth example, wherein the respective values of the one or more spherical harmonic coefficients are expressed as one or more higher-order ambisonic (HOA) signals.

In an eighty-seventh example, the device of the eighty-sixth example, wherein the one or more HOA signals comprise $(N+1)^2$ channels.

In an eighty-eighth example, the device of any of the eighty-sixth example, the eighty-seventh example or combinations thereof, wherein the one or more HOA signals are associated with a single instance of time.

In an eighty-ninth example, the device of any of the eighty-first through the eighty-eighth examples or combinations thereof, wherein the positional masking threshold is associated with the single instance of time.

In a ninetieth example, the device of any of claims the eighty-first through the eighty-ninth examples or combinations thereof, wherein the positional masking threshold is associated with $(N+1)^2$ channels, and N denotes an order of the spherical harmonic coefficients.

In a ninety-first example, the device of any of the eighty-first through ninetieth examples or combinations thereof, further comprising means for determining whether each of the one or more spherical harmonic coefficients is spatially masked.

In a ninety-second example, the device of the ninety-first example, wherein the means for determining whether each of the one or more spherical harmonic coefficients is spatially masked comprises means for comparing each of the one or more spherical harmonic coefficients to the positional masking threshold.

In a ninety-third example, the device of any of the ninety-first example, the ninety-second example or combinations thereof, further comprising means for determining, when one of the one or more spherical harmonic coefficients is spatially masked, that the spatially masked spherical harmonic coefficient is irrelevant.

In a ninety-fourth example, the device of the ninety-third example, further comprising means for discarding the irrelevant spherical harmonic coefficient.

In a ninety-fifth example, the techniques may furthermore provide for a device comprising means for determining a positional masking matrix based on simulated data expressed in a spherical harmonics domain, and means for applying a positional masking matrix to one or more spherical harmonic coefficients to generate a positional masking threshold.

In a ninety-sixth example, the device of the ninety-fifth example, further comprising means for performing the steps of the method recited by any of the first through the thirty-fifth examples, or combinations thereof.

In a ninety-seventh example, the techniques may also provide for a device comprising means for determining a radii-based positional mapping of one or more spherical harmonic coefficients (SHC), using one or more complex representations of the SHC, and means for storing the radii-based positional mapping.

In a ninety-eighth example, the device of the ninety-seventh example, wherein the radii-based positional mapping is based at least in part on values of respective radii of one or more spheres represented by the SHC.

In a ninety-ninth example, the device of the ninety-eighth example, wherein the complex representations represent the respective radii of the one or more spheres represented by the SHC.

In a hundredth example, the device of any of the ninety-seventh through the ninety-ninth examples or combination thereof, wherein the complex representations are associated with respective representations of the SHC in a mathematical context.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various embodiments of the techniques have been described. These and other aspects of the techniques are within the scope of the following claims.

What is claimed is:

1. A method of compressing audio data comprising spherical harmonic coefficients, the method comprising:

allocating a first set of bits to the spherical harmonic coefficients corresponding to a spherical basis function having an order of zero based on one or more predetermined properties of human hearing;

allocating a second set of bits to the spherical harmonic coefficients corresponding to a spherical basis function having an order greater than zero using, at least in part, a bit allocation mechanism that is based on a saliency of each of the spherical harmonic coefficients corresponding to the spherical basis function having the order greater than zero;

quantizing, based on the first set of bits, the spherical harmonic coefficients corresponding to the spherical basis function having an order of zero;

quantizing, based on the second set of bits, the spherical harmonic coefficients corresponding to the spherical basis function having an order greater than zero; and generating an audio bitstream that includes the quantized the spherical harmonic coefficients corresponding to the spherical basis function having an order of zero and the quantized spherical harmonic coefficients corresponding to the spherical basis function having an order greater than zero.

2. The method of claim 1, wherein allocating the second set of bits to the spherical harmonic coefficients corresponding to the spherical basis function having the order greater than zero comprises performing positional masking with respect to the audio data using a positional masking threshold.

3. The method of claim 2, wherein allocating the second set of bits to the spherical harmonic coefficients corresponding to the spherical basis function having the order greater than zero comprises allocating no bits to one or more portions of the spherical harmonic coefficients corresponding to the spherical basis function having the order greater than zero based at least in part by performing the positional analysis on the spherical harmonic coefficients corresponding to the spherical basis function having the order greater than zero.

4. The method of claim 2, wherein allocating the second set of bits to the spherical harmonic coefficients corresponding to the spherical basis function having the order greater than zero comprises allocating fewer bits to one portion of the spherical harmonic coefficients corresponding to the spherical basis function having the order greater than zero than another portion of the spherical harmonic coefficients corresponding to the spherical basis function having the order greater than zero at least in part by performing the positional analysis on the audio data.

5. The method of claim 1, further comprising:

identifying a simultaneous masking threshold by at least in part performing a simultaneous analysis of the spherical harmonic coefficients corresponding to the spherical basis function having the order of zero and the order greater than zero; and performing simultaneous masking with respect to the spherical harmonic coefficients corresponding to the spherical basis function having the order of zero and the order greater than zero using the simultaneous masking threshold.

6. The method of claim 1, further comprising determining a spatial map associated with the spherical harmonic coefficients corresponding to the spherical basis function having the order of zero and the order greater than zero.

7. The method of claim 6, further comprising performing a positional analysis based on the spatial map.

8. The method of claim 6, further comprising determining the saliency of each of the spherical harmonic coefficients corresponding to the spherical basis function having the order greater than zero based on a spatial analysis of the spherical harmonic coefficients corresponding to the spherical basis function having the order greater than zero.

9. The method of claim 6, wherein the spatial map is based on a radius of a sphere defined by the larger plurality of spherical harmonic coefficients.

10. The method of claim 6, wherein the spatial map is based on one or more azimuth values of a sphere defined by the spherical harmonic coefficients corresponding to the spherical basis function having the order of zero and the order greater than zero.

11. The method of claim 6, wherein the spatial map is based on one or more azimuth values associated with a sphere defined by the spherical harmonic coefficients corresponding to the spherical basis function having the order of zero and the order greater than zero.

12. The method of claim 6, wherein the spatial map is based on one or more angles associated with a sphere defined by the spherical harmonic coefficients corresponding to the spherical basis function having the order of zero and the order greater than zero.

13. The method of claim 6, wherein the spatial map is based on one or more elevation angles associated with a sphere defined by the spherical harmonic coefficients corresponding to the spherical basis function having the order of zero and the order greater than zero.

14. The method of claim 6, wherein the spatial map is based on one or more spatial properties of a sphere defined by the spherical harmonic coefficients corresponding to the spherical basis function having the order of zero and the order greater than zero, the spatial properties including one or more of a radius of the sphere, a diameter of the sphere, a volume of the sphere, one or more azimuth values associated with the sphere, one or more angles associated with the sphere, and one or more elevation angles associated with the sphere.

15. The method of claim 1, wherein the saliency of each of the spherical harmonic coefficients corresponding to the spherical basis function having the order greater than zero indicates a relative importance of each of the spherical harmonic coefficients corresponding to the spherical basis function having the order greater than zero in a full context of audio data defined by the spherical harmonic coefficients corresponding to spherical basis functions having the order equal to zero and greater than zero.

16. The method of claim 1, further comprising converting each of the spherical harmonic coefficients corresponding to the spherical basis function having the order of zero and the order greater than zero to a complex representation of the corresponding spherical harmonic coefficient.

17. The method of claim 15, further comprising:

identifying a simultaneous masking threshold representative of the properties of human hearing by at least in part performing a simultaneous analysis of the spherical harmonic coefficients corresponding to the spherical basis function having the order of zero and the order greater than zero, wherein allocating the first set of bits comprises performing simultaneous masking with respect to the spherical harmonic coefficients corresponding to the spherical basis function having the order of zero using the simultaneous masking threshold to allocate the first set of bits.

18. The method of claim 1, further comprising dividing each of the spherical harmonic coefficients corresponding to the spherical basis function having the order greater than zero by an absolute value defined by the spherical harmonic coefficients corresponding to the spherical basis function having the order of zero to form a corresponding directional value for each of the spherical harmonic coefficients corresponding to the spherical basis function having the order greater than zero.

19. The method of claim 18, further comprising quantizing each of the corresponding directional values.

20. The method of claim 15, wherein an absolute value defined by each of the spherical harmonic coefficients corresponding to the spherical basis function having the order of zero is associated with an energy value of each of the spherical harmonic coefficients corresponding to the spherical basis function having the order greater than zero.

21. An audio compression device comprising:

a memory configured to store audio data comprising spherical harmonic coefficients; and one or more processors configured to:

allocate a first set of bits to the spherical harmonic coefficients corresponding to a spherical basis function having an order of zero based on one or more predetermined properties of human hearing;

allocate a second set of bits to the spherical harmonic coefficients corresponding to a spherical basis function having an order greater than zero using, at least in part, a bit allocation mechanism that is based on a saliency of each of the spherical harmonic coefficients corresponding to the spherical basis function having the order greater than zero;

quantize, based on the first set of bits, the spherical harmonic coefficients corresponding to the spherical basis function having an order of zero;

quantize, based on the second set of bits, the spherical harmonic coefficients corresponding to the spherical basis function having an order greater than zero; and generate an audio bitstream that includes the quantized the spherical harmonic coefficients corresponding to the spherical basis function having an order of zero and the quantized spherical harmonic coefficients corresponding to the spherical basis function having an order greater than zero.

22. The audio compression device of claim 21, wherein, to allocate the second set of bits to the spherical harmonic coefficients corresponding to the spherical basis function having the order greater than zero, the one or more processors are configured to perform positional masking with respect to the audio data using a positional masking threshold.

23. The audio compression device of claim 22, wherein the one or more processors are configured to allocate no bits to one or more portions of the spherical harmonic coefficients corresponding to the spherical basis function having the order greater than zero based at least in part by performing the positional analysis on the spherical harmonic coefficients corresponding to the spherical basis function having the order greater than zero.

24. The audio compression device of claim 22, wherein the one or more processors are configured to allocate fewer bits to one portion of the spherical harmonic coefficients corresponding to the spherical basis function having the order greater than zero than another portion of the spherical harmonic coefficients corresponding to the spherical basis function having the order greater than zero at least in part by performing the positional analysis on the audio data.

25. The audio compression device of claim 21, wherein the one or more processors are further configured to identify a simultaneous masking threshold by at least in part performing a simultaneous analysis of the spherical harmonic coefficients corresponding to the spherical basis function having the order of zero and the order greater than zero, and perform simultaneous masking with respect to the spherical harmonic coefficients corresponding to the spherical basis function having the order of zero and the order greater than zero using the simultaneous masking threshold.

26. The audio compression device of claim 21, wherein the one or more processors are further configured to determine a spatial map associated with the spherical harmonic coefficients corresponding to the spherical basis function having the order of zero and the order greater than zero.

27. The audio compression device of claim 26, wherein the one or more processors are further configured to perform a positional analysis based on the spatial map.

28. The audio compression device of claim 26, wherein the one or more processors are further configured to determine the saliency of each of the spherical harmonic coefficients corresponding to the spherical basis function having the order greater than zero based on a spatial analysis of the spherical harmonic coefficients corresponding to the spherical basis function having the order greater than zero.

29. The audio compression device of claim 26, wherein the spatial map is based on a radius of a sphere defined by the larger plurality of spherical harmonic coefficients.

30. The audio compression device of claim 26, wherein the spatial map is based on one or more azimuth values of a sphere defined by the spherical harmonic coefficients corresponding to the spherical basis function having the order of zero and the order greater than zero.

31. The audio compression device of claim 26, wherein the spatial map is based on one or more azimuth values associated with a sphere defined by the spherical harmonic coefficients corresponding to the spherical basis function having the order of zero and the order greater than zero.

32. The audio compression device of claim 26, wherein the spatial map is based on one or more angles associated with a sphere defined by the spherical harmonic coefficients corresponding to the spherical basis function having the order of zero and the order greater than zero.

33. The audio compression device of claim 26, wherein the spatial map is based on one or more elevation angles associated with a sphere defined by the spherical harmonic coefficients corresponding to the spherical basis function having the order of zero and the order greater than zero.

34. The audio compression device of claim 26, wherein the spatial map is based on one or more spatial properties of a sphere defined by the spherical harmonic coefficients corresponding to the spherical basis function having the order of zero and the order greater than zero, the spatial properties including one or more of a radius of the sphere, a diameter of the sphere, a volume of the sphere, one or more azimuth values associated with the sphere, one or more angles associated with the sphere, and one or more elevation angles associated with the sphere.

35. The audio compression device of claim 21, wherein the saliency of each of the spherical harmonic coefficients corresponding to the spherical basis function having the order greater than zero indicates a relative importance of each of the spherical harmonic coefficients corresponding to the spherical basis function having the order greater than zero in a full context of audio data defined by the spherical harmonic coefficients corresponding to spherical basis functions having the order equal to zero and greater than zero.

36. The audio compression device of claim 35, wherein the one or more processors are further configured to convert each of the spherical harmonic coefficients corresponding to the spherical basis function having the order of zero and the order greater than zero to a complex representation of the corresponding spherical harmonic coefficient.

37. The audio compression device of claim 35, wherein the one or more processors are further configured to identify a simultaneous masking threshold representative of the properties of human hearing by at least in part performing a simultaneous analysis of the spherical harmonic coefficients corresponding to the spherical basis function having the order of zero and the order greater than zero, and wherein the one or more processors are configured to perform simultaneous masking with respect to the spherical harmonic coefficients corresponding to the spherical basis function having the order of zero using the simultaneous masking threshold to allocate the first set of bits.

38. The audio compression device of claim 35, wherein the one or more processors are further configured to divide each of the spherical harmonic coefficients corresponding to the spherical basis function having the order greater than zero by an absolute value defined by the spherical harmonic coefficients corresponding to the spherical basis function having the order of zero to form a corresponding directional value for each of the spherical harmonic coefficients corresponding to the spherical basis function having the order greater than zero.

39. The audio compression device of claim 38, wherein the one or more processors are further configured to quantize each corresponding directional value.

40. The audio compression device of claim 35, wherein an absolute value defined by each of the spherical harmonic coefficients corresponding to the spherical basis function having the order of zero is associated with an energy value of each of the spherical harmonic coefficients corresponding to the spherical basis function having the order greater than zero.

41. An audio compression device comprising:

means for storing audio data comprising spherical harmonic coefficients;

means for allocating a first set of bits to the spherical harmonic coefficients corresponding to a spherical basis function having an order of zero based on one or more predetermined properties of human hearing;

means for allocating, a second set of bits to the spherical harmonic coefficients corresponding to a spherical basis function having an order greater than zero using, at least in part, a bit allocation mechanism that is based on a saliency of each of the spherical harmonic coefficients corresponding to the spherical basis function having the order greater than zero;

means for quantizing, based on the first set of bits, the spherical harmonic coefficients corresponding to the spherical basis function having an order of zero;

means for quantizing, based on the second set of bits, the spherical harmonic coefficients corresponding to the spherical basis function having an order greater than zero; and means for generating an audio bitstream that includes the quantized the spherical harmonic coefficients corresponding to the spherical basis function having an order of zero and the quantized spherical harmonic coefficients corresponding to the spherical basis function having an order greater than zero.

42. A non-transitory computer-readable storage medium having stored thereon instructions that, when executed, cause one or more processors to:

allocate a first set of bits to spherical harmonic coefficients corresponding to a spherical basis function having an order of zero based on one or more predetermined properties of human hearing;

allocate a second set of bits to spherical harmonic coefficients corresponding to a spherical basis function having an order greater than zero using, at least in part, a bit allocation mechanism that is based on a saliency of each of the spherical harmonic coefficients corresponding to the spherical basis function having the order greater than zero;

quantize, based on the first set of bits, the spherical harmonic coefficients corresponding to the spherical basis function having an order of zero;

quantize, based on the second set of bits, the spherical harmonic coefficients corresponding to the spherical basis function having an order greater than zero; and generate an audio bitstream that includes the quantized the spherical harmonic coefficients corresponding to the spherical basis function having an order of zero and the quantized spherical harmonic coefficients corresponding to the spherical basis function having an order greater than zero.

* * * * *